United States Patent [19]

Katsuno et al.

[11] Patent Number: 4,707,984

[45] Date of Patent: Nov. 24, 1987

[54] DOUBLE AIR-FUEL RATIO SENSOR SYSTEM HAVING IMPROVED RESPONSE CHARACTERISTICS

[75] Inventors: Toshiyasu Katsuno; Toshinari Nagai, both of Susono; Takatoshi Masui; Yasushi Satou, both of Mishima, all of Japan

[73] Assignee: Toyota Jidosha Kabushiki Kaisha, Aichi, Japan

[21] Appl. No.: 850,619

[22] Filed: Apr. 11, 1986

[30] Foreign Application Priority Data

Apr. 15, 1985 [JP] Japan ..... 60-78528
Jun. 13, 1985 [JP] Japan ..... 60-127119
Jun. 17, 1985 [JP] Japan ..... 60-129905

[51] Int. Cl.[4] ..... F02D 41/14

[52] U.S. Cl. ..... 60/274; 60/276; 60/285; 123/489; 123/491

[58] Field of Search ..... 123/440, 489, 589, 491; 60/276, 285, 274; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,177,787 | 12/1979 | Hattori et al. | 123/440 |
| 4,235,204 | 11/1980 | Rice | 123/440 |
| 4,251,989 | 2/1981 | Norimatsu et al. | 123/440 |
| 4,399,792 | 8/1983 | Otsuka et al. | 123/491 |
| 4,475,517 | 10/1984 | Kobayashi et al. | 123/489 |
| 4,497,296 | 2/1985 | Nakajima et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-53661 | 3/1983 | Japan . |
| 58-48755 | 3/1983 | Japan . |
| 58-48756 | 3/1983 | Japan . |
| 58-72646 | 4/1983 | Japan . |
| 58-72647 | 4/1983 | Japan . |
| 58-135343 | 8/1983 | Japan . |
| 58-152147 | 9/1983 | Japan . |
| 58-150038 | 9/1983 | Japan . |
| 58-150039 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Parkhurst & Oliff

[57] ABSTRACT

In a double air-fuel sensor system including two air-fuel ratio sensors upstream and downstream of a catalyst converter provided in an exhaust gas passage, an actual air-fuel ratio is adjusted in accordance with the outputs of the upstream-side air-fuel ratio sensor and the downstream-side air-fuel ratio sensor. The adjustment of the actual air-fuel ratio by the downstream-side air-fuel ratio sensor is prohibited in accordance with a coolant temperature of the engine.

38 Claims, 62 Drawing Figures

LEAN
RICH
A/F
TDR1
CDLY1

0
t1
t2
t3
t4
t5
t6
t7
t8
TDL1

TDR1
LEAN
RICH
(-TDL1)
TDR1
F1

RSL
KIR
FAF1
RSR
KIL

| |
|---|
| Fig. 8A |
| Fig. 8B |

| Fig.12A | Fig.12B | Fig.12C |
|---|---|---|

V
1
0
V1
VR1
RICH
LEAN
TDR1
(-TDL1)
F1
KIR
RSL
FAF1
RSR
KIL
V2
VR2
LEAN
RICH
(-TDL2)
TDR2
F2
KI2
RS2
FAF2
RS2
KI2
RS2

| |
|---|
| Fig. 15A |
| Fig. 15B |

V
1
0
V1
VR1
RICH
LEAN
TDR1
(-TDL1)
F1
KIR
RSL
FAF1
RSR
KIL
V2
VR2
(-TDL2)
TDR2
F2
TR1
TDR1
TR2
TL1
TDL1
TL2

COLD START
HOT START

SPD
t1
t2'
t2
t3
t4

THW
70°C

ACTIVITY
X1
PRIOR ART
VR2

V2
PRESENT INVENTION

FAF2
PRESENT INVENTION

CO
PRESENT INVENTION

LEAN
RICH
A/F1

TDL1
CDLY1
0
t1 t2
t3
t4
t5 t6 t7
t8
TDR1

(-TDR1)
LEAN
RICH
TDL1
(-TDR1)
F1

KIR
KIL
FAF1
RSL
RSR

DOUBLE AIR-FUEL RATIO SENSOR SYSTEM HAVING IMPROVED RESPONSE CHARACTERISTICS

BACKGROUND OF THE INVENTION

1. Field of the Invention

The present invention relates to a method and apparatus for feedback control of an air-fuel ratio in an internal combustion engine having two air-fuel ratio sensors upstream and downstream of a catalyst converter disposed within an exhaust gas passage.

2. Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output signal of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_x$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos.° 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, since the downstream-side air-fuel ratio sensor is located on a low temperature side when compared with the upstream-side air-fuel ratio sensor, it will take a relatively long time for the downstream-side air-fuel ratio sensor to be activated. Therefore, when a feedback control by the downstream-side air-fuel ratio sensor is carried out before the downstream-side air-fuel ratio sensor is activated, the controlled air-fuel ratio again becomes overrich or overlean due to the inclination of the output of the downstream-side air-fuel ratio sensor thus deteriorating the fuel consumption, the drivability, and the conditions of the exhaust emission characteristics for the HC, CO, and $NO_x$ components thereof.

Note that, if the activation/deactivation of the downstream-side $O_2$ sensor is carried out by determining whether or not the output of the downstream-side $O_2$ sensor is swung from the lean side to the rich side or vice versa, it is impossible to obtain the determination of activation of the downstream-side $O_2$ sensor when the output thereof is inclined to the rich side or the lean side. Also, the determination of deactivation of the downstream-side $O_2$ sensor cannot be obtained, even when the temperature thereof is reduced at an intermediate state of driving the engine.

SUMMARY OF THE INVENTION

It is an object of the present invention to provide a double air-fuel ratio sensor system in an internal combustion engine with which the fuel consumption, the drivability, and the exhaust emission characteristics are improved when the downstream-side $O_2$ sensor is in an deactivation state.

According to the present invention, in a double air-fuel ratio sensor system including two $O_2$ sensors upstream and downstream of a catalyst converter provided in an exhaust passage, an actual air-fuel ratio is adjusted in accordance with the outputs of the upstream-side air-fuel ratio sensor and the downstream-side air-fuel ratio sensor. The adjustment of the actual air-fuel ratio by the downstream-side air-fuel ratio sensor is prohibited in accordance with a coolant temperature of the engine. Since the sensor temperature of the downstream-side air-fuel ratio sensor can be detected indirectly by the temperature of the coolant, the activation/deactivation of the downstream-side air-fuel ratio sensor can be properly carried out.

BRIEF DESCRIPTION OF THE DRAWINGS

The present invention will be more clearly understood from the description as set forth below with reference to the accompanying drawings, wherein:

FIGS. 5, 5A–5C, 7, 8, 8A–8B, 10, 11, 12, 12A–12C, 13, 14, 16, 20, and 22 are flow charts showing the operation of the control circuit of FIG. 2;

DESCRIPTION OF THE PREFERRED EMBODIMENTS

Figure 1:
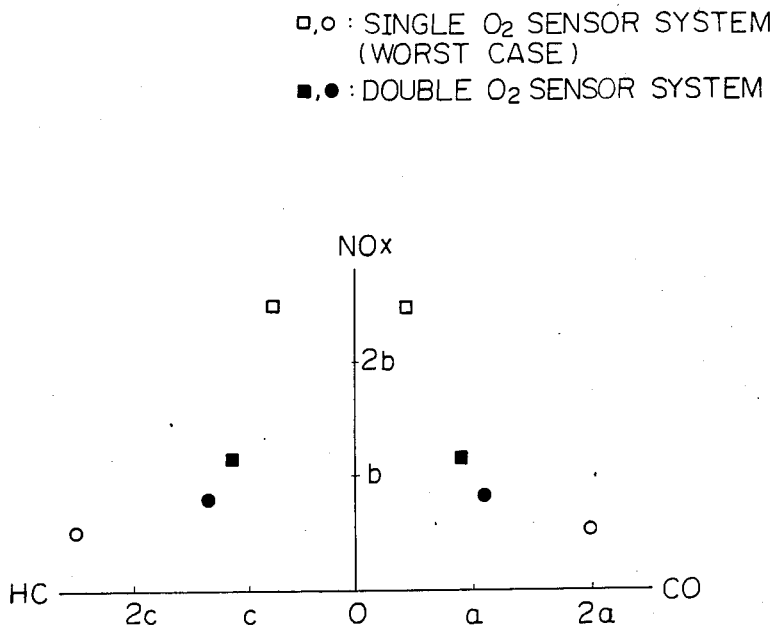
FIG. 1 is a graph showing the emission characteristics of a single $O_2$ sensor system (worst case) and a double $O_2$ sensor system.
Figure 2:
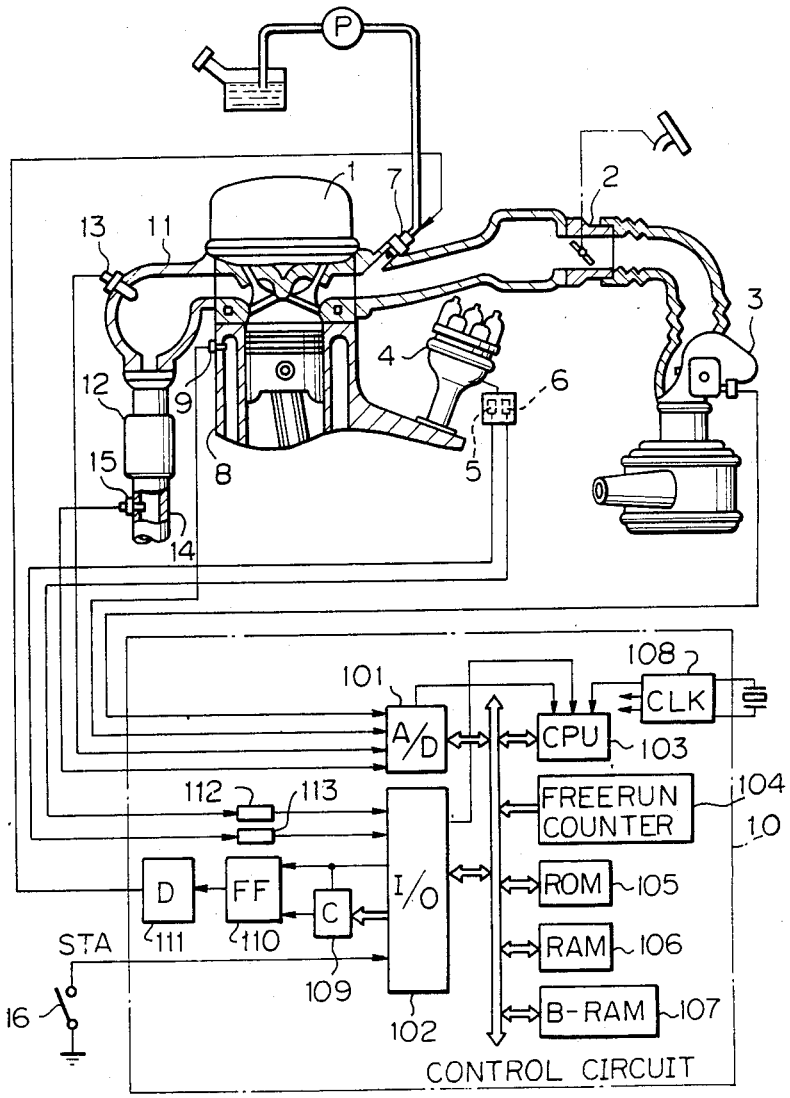
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1. In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and $No_x$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit them via signal processing circuits 112 and 113 to the A/D converter 101 of the control circuit 10.

Reference numeral 16 designates a starter switch which generates and transmits an output STA to the I/O interface 102 of the control circuit 10.

The control circuit 10, which may be constructed by a microcomputer, further comprises a central processing unit (CPU) 103, a freerun converter 104, a read-only memory (ROM) 105 for storing a main routine, interrupt routines such as a fuel injection routine, an ignition timing routine, tables (maps), constants, etc., a random access memory 106 (RAM) for storing temporary data, a backup RAM 107, a clock generator 108 for generating various clock signals, a down counter 109, a flip-flop 110, a driver circuit 111, and the like.

Note that the battery (not shown) is connected directly to the backup RAM 107 and, therefore, the content thereof is never erased even when the ignition switch (not shown) is turned off.

The down counter 109, the flip-flop 110, and the driver circuit 111 are used for controlling the fuel injection valve 7. That is, when a fuel injection amount TAU is calculated in a TAU routine, which will be later explained, the amount TAU is preset in the down counter 109, and simultaneously, the flip-flop 110 is set. As a result, the driver circuit 111 initiates the activation of the fuel injection valve 7. On the other hand, the down counter 109 counts up the clock signal from the clock generator 108, and finally generates a logic "1" signal from the carry-out terminal of the down counter 109, to reset the flip-flop 110, so that the driver circuit 111 stops the activation of the fuel injection valve 7. Thus, the amount of fuel corresponding to the fuel injection amount TAU is injected into the fuel injection valve 7.

Interruptions occur at the CPU 103, when the A/D converter 101 completes an A/D conversion and generates an interrupt signal; when the crank angle sensor 6 generates a pulse signal; and when the clock generator 108 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 106 are renewed at every predetermined time period. The engine speed Ne is calculated by an interrupt routine executed at 30° CA, i.e., at every pulse signal of the crank angle sensor 6, and is then stored in the RAM 106.

Figure 3A:
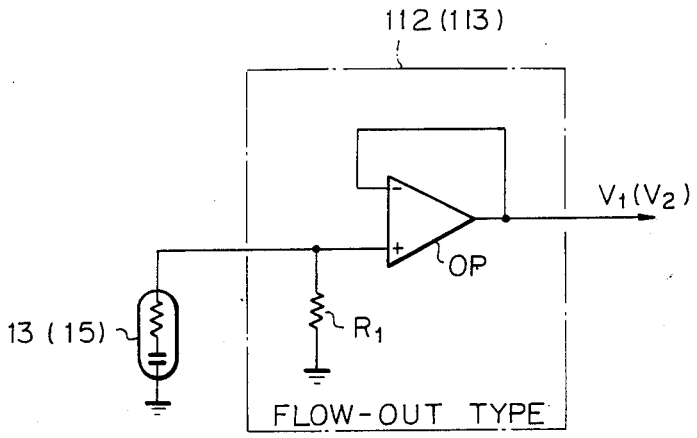
FIGS. 3A and 3B are circuit diagrams of the signal processing circuits of FIG. 2.
Figure 3B:
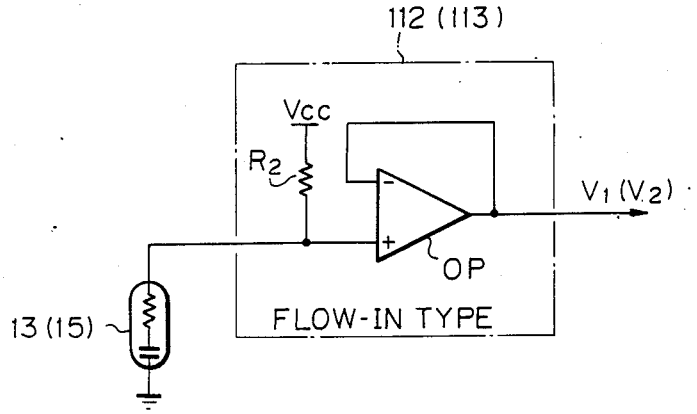
Figure 4A:
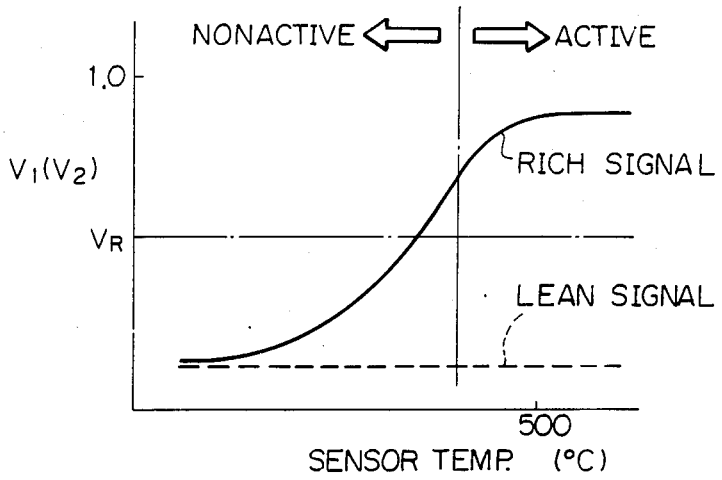
FIGS. 4A and 4B are graphs showing the output characteristics of the signal processing circuits of FIGS. 3A and 3B, respectively.
Figure 4B:
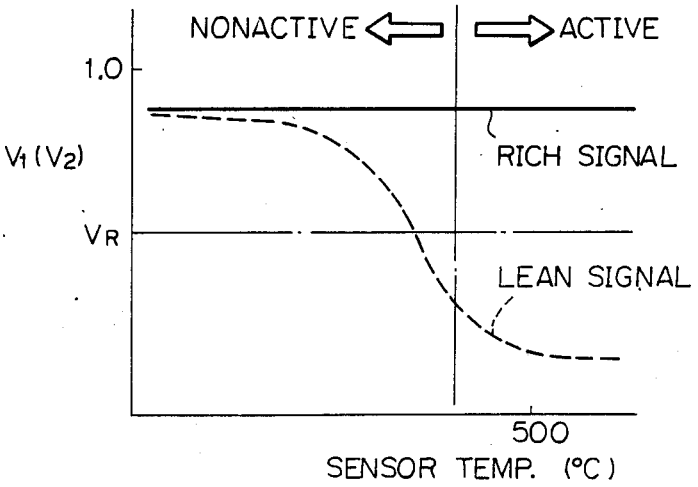

There are two types of signal processing circuits 118 and 113, i.e., the flow-out type and the flow-in type. As illustrated in FIG. 3A, the flow-out type signal processing circuit comprises a grounded resistor $R_1$ and a voltage buffer OP. Therefore, as shown in FIG. 4A, when the temperature of the $O_2$ sensor 13 (or 15) is low and the $O_2$ sensor 13 (or 15) is in a nonactive state, the output of the signal processing circuit 112 (or 113) is low, due to sink currents by the resistor $R_1$, regardless of the rich or lean state of the $O_2$ sensor 13 (or 15). Contrary to this, when the $O_2$ sensor 13 (or 15) is activated by an increase of the temperature of the signal processing circuit 112 (or 113) generates a rich signal which has a high potential or a lean signal which has a low potential. Therefore, in this case, the activation/deactivation state of the $O_2$ sensor 13 (or 15) can be determined by whether a rich signal is low or high. On the other hand, as illustrated in FIG. 3B, the flow-in type signal processing circuit comprises a resistor $R_2$ connected to a power supply $V_{CC}$ and a voltage buffer OP. Therefore, when the temperature of the $O_2$ sensor 13 (or 15) is low and the $O_2$ sensor 13 (or 15) is in a nonactive state, the output of the signal processing circuit 112 (or 113) is high, due to source currents by the resistor $R_2$, regardless of the rich or lean stage of the $O_2$ sensor 13 (or 15). Contrary to this, when the $O_2$ sensor 13 (or 15) is activated by an increase of the temperature thereof, the signal processing circuit 112 (or 113) generates a high potential rich signal or a low potential lean signal. Therefore, in this case, the activation/deactivation state of the $O_2$ sensor 13 (or 15) can be determined by whether a lean signal is low or high.

Note that, hereinafter, the signal processing circuits 112 and 113 are the flow-out type., The operation of the control circuit 10 of FIG. 2 will be now explained.

Figures 5, 5A:
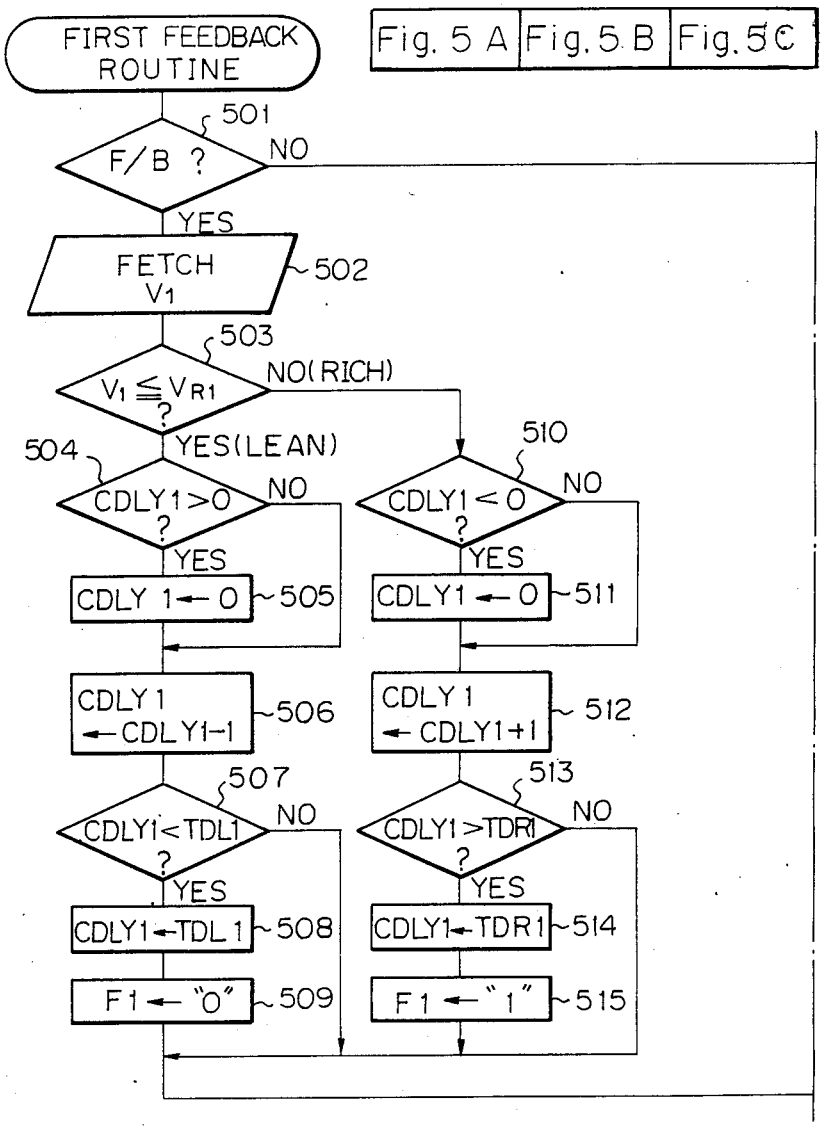
Figure 5B:
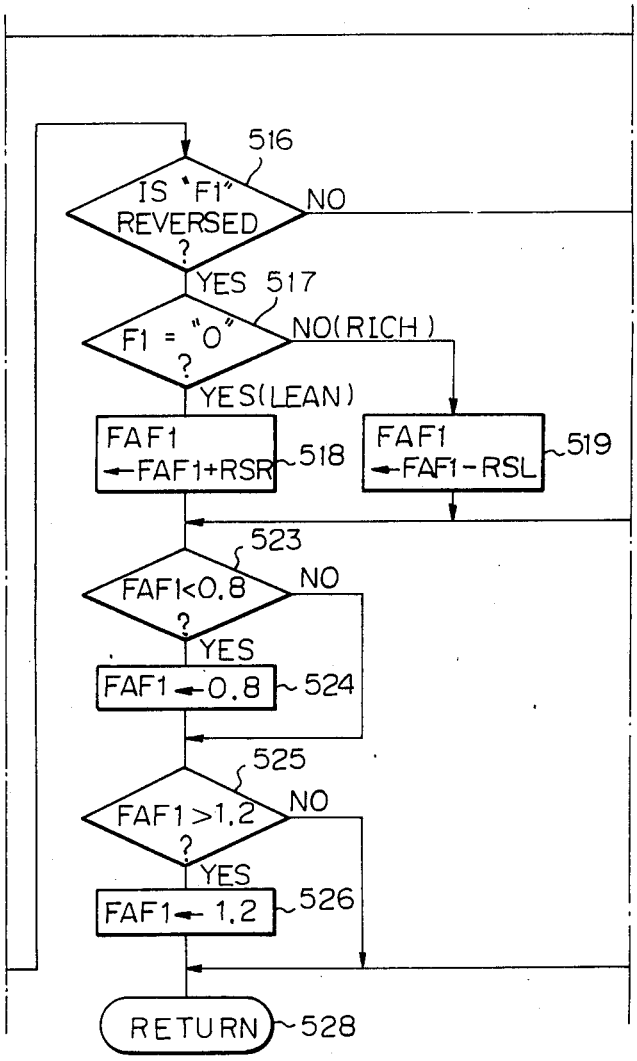
Figure 5C:
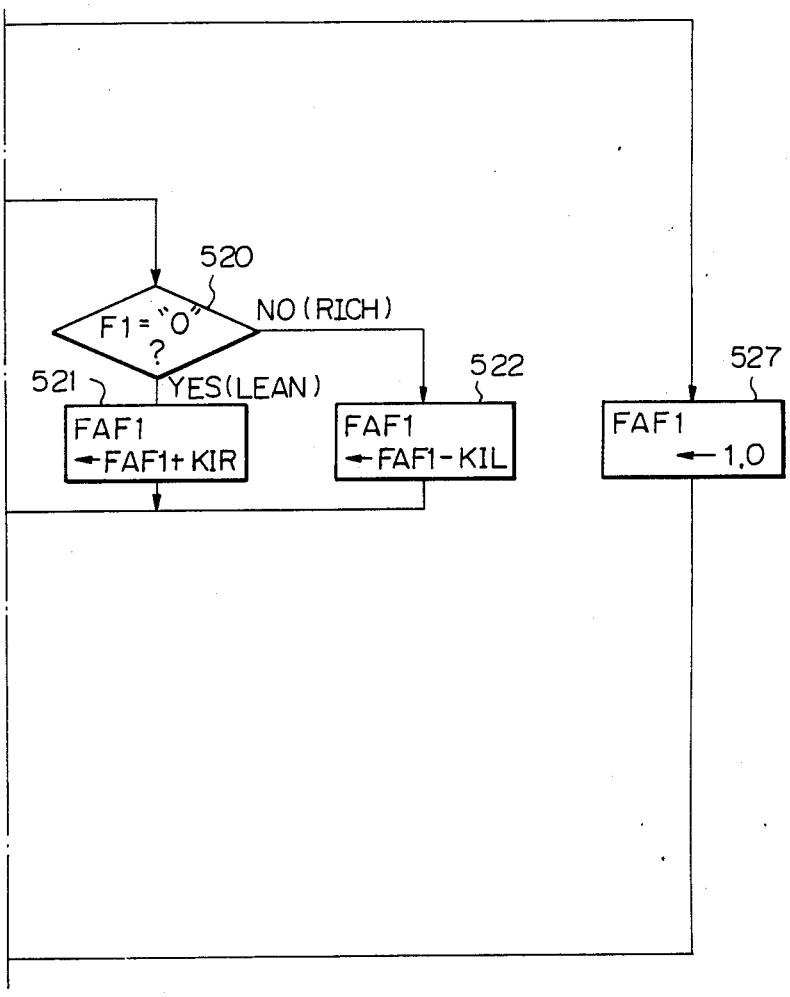

FIG. 5 is a routine for calculating a first air-fuel ratio feedback correction amount FAF1 in accordance with the output of the upstream-side $O_2$ sensor 13 executed at every predetermined time period such as 4 ms.

At step 501, it is determined whether or not all the feedback control (closed-loop control) conditions by the upstream-side $O_2$ sensor 13 are satisfied. The feedback control conditions are as follows:

(i) the engine is not in a starting state;
(ii) the coolant temperature THW is higher than 50° C.;
(iii) the power fuel incremental amount FPOWER is 0; and
(iv) the upstream-side $O_2$ sensor 13 is in an activated state.

Note that the determination of activation/non-activation of the upstream-side $O_2$ sensor 13 is carried out by determining whether or not the coolant temperature THW≧70° C., or by whether or not the output of the upstream-side $O_2$ sensor 13 is once swung, i.e., one changed from the rich side to the lean side, or vice versa. Of course, other feedback control conditions are introduced as occasion demands. However, an explanation of such other feedback control conditions is omitted.

If one or more of the feedback control conditions is not satisfied, the control proceeds to step 527, in which the amount FAF1 is caused to be 1.0 (FAF1=1.0), thereby carrying out an open-loop control operation. Note that, in this case, the correction amount FAF1 can be a learning value or a value immediately before the feedback control by the upsteam $O_2$ sensor 13 is stopped.

Contrary to the above, at step 501, if all of the feedback control conditions are satisfied, the control proceeds to step 402.

At step 502, an A/D conversion is performed upon the output voltage $V_1$ of the upstream-side $O_2$ sensor 13, and the A/D converted value thereof is then fetched from the A/D converter 101. Then at step 403, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 504, which determines whether or not the value of a first delay counter CDLY1 is positive. If CDLY1>0, the control proceeds to step 505, which clears the first delay counter CDLY1, and then proceeds to step 506. If CDLY1≦0, the control proceeds directly to step 506. At step 506, the first delay counter CDLY1 is counted down by 1, and at step 507, it is determined whether or not CDLY1<TDL1. Note that TDL1 is a lean delay time period for which a rich state is maintained even after the output of the upsteam-side $O_2$ sensor 13 is changed from the rich side to the lean side, and is defined by a negative value. Therefore, at step 507, only when CDLY1<TDL1 does the control proceed to step 508, which causes CDLY1 to be TDL1, and then to step 509, which causes a first air-fuel ratio flag F1 to be "0" (lean state). On the other hand, if $V_1 > V_{R1}$, which means that the current air-fuel ratio is rich, the control proceeds to step 510, which determines whether or not the value of the first delay counter CDLY1 is negative. If CDLY1<0, the control proceeds to step 511, which clears the first delay counter CDLY1, and then proceeds to step 512. If CDLY1≧0, the control directly proceeds to 512. At step 512, the first delay counter CDLY1 is counted up by 1, and at step 513, it is determined whether or not CDLY1>TDR1. Note that TDR1 is a rich delay time period for which a lean state is maintained even after the output of the upstream-side $O_2$ sensor 13 is changed from the lean side to the rich side, and is defined by a positive value. Therefore, at step 513, only when CDLY1 >TDR1 does the control proceed to step 514, which causes CDLY1 to be TDR1, and then to step 515, which causes the first air-fuel ratio flag F1 to be "1" (rich state).

Next, at step 516, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 517 to 519, which carry out a skip operation. That is, if the flag F1 is "0" (lean) at step 517, the control proceeds to step 518, which remarkably increases the correction amount FAF by a skip amount RSR. Also, if the flag F1 is "1" (rich) at step 517, the control proceeds to step 519, which remarkably decreases the correction amount FAF by the skip amount RSL. On the other hand, if the first air-fuel ratio flag F1 is not reversed at step 516, the control proceeds to step 520 to 522, which carries out an integration operation. That is, if the flag F1 is "0" (lean) at step 520, the control proceeds to step 521, which gradually increases the correction amount FAF1 by a rich integration amount KIR. Also, if the flag F1 is "1" (rich) at step 520, the control proceeds to step 522, which gradually decreases the correction amount FAF1 by a lean integration amount KIL.

The correction amount FAF1 is guarded by a minimum value 0.8 at steps 523 and 524, and by a maximum value 1.2 at steps 525 and 526, thereby also preventing the controlled air-fuel ratio from becoming overrich or overlean.

The correction amount FAF1 is then stored in the RAM 105, thus completing this routine of FIG. 5 at step 528.

Figures 6A, 6B, 6C, 6D:
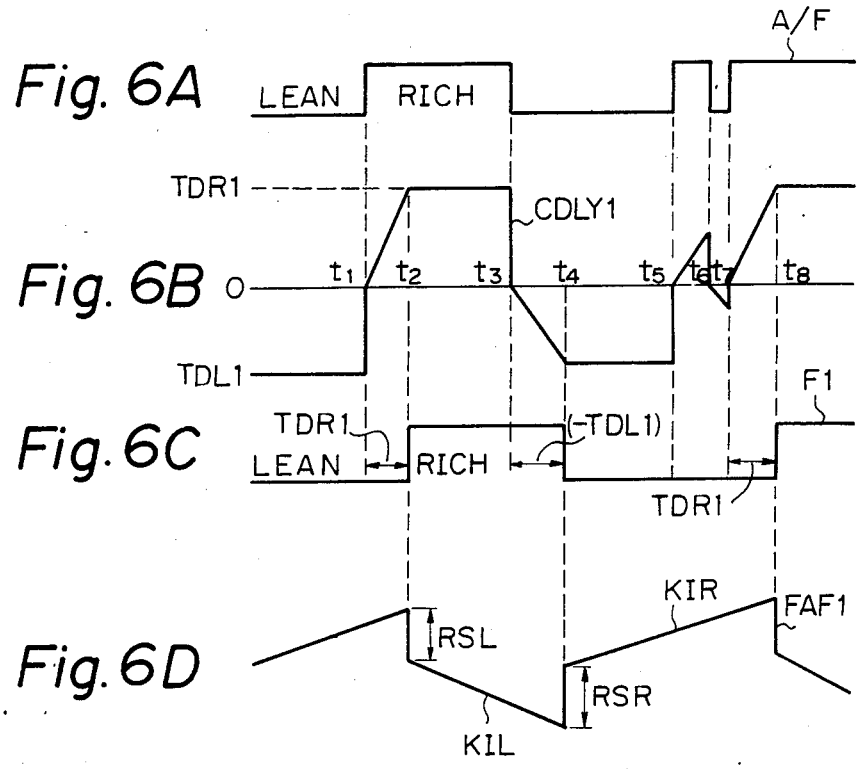
FIGS. 6A through 6D are timing diagrams explaining the flow charts of FIG. 5.

The operation by the flow chart of FIG. 5 will be further explained with reference to FIGS. 6A through 6D. As illustrated in FIG. 6A, when the air-fuel ratio A/F is obtained by the output of the upstream-side $O_2$ sensor 13, the first delay counter CDLY1 is counted up during a rich state, and is counted down during a lean state, as illustrated in FIG. 6B. As a result, a delayed air-fuel ratio corresponding to the first air-fuel ratio flag F1 is obtained as illustrated in FIG. 6C. For example, at time $t_1$, even when the air-fuel ratio A/F is changed from the lean side to the rich side, the delayed air-fuel ratio F1 is changed at time $t_2$ after the rich delay time period TDR1. Similarly, at time $t_3$, even when the air-fuel ratio A/F is changed from the rich side to the lean side, the delayed air-fuel ratio F1 is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio F1 is reversed at time $t_8$. That is, the delayed air-fuel ratio F1 is stable when compared with the air-fuel ratio A/F. Further, as illustrated in FIG. 6D, at every change of the delayed air-fuel ratio F1 from the rich side to the lean side, or vice versa, the correction amount FAF1 is skipped by the skip amount RSR or RSL, and also, the correction amount FAF1 is gradually increased or decreased in accordance with the delayed air-fuel ratio F1.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR1 and the lean delay time period TDL1), a skip amount RS (in more detail, the rich skip amount RSR and the lean skip amount RSL), and an integration amount KI (in more detail, the rich integration amount KIR and the lean integration amount KIL).

For example, if the rich delay time period becomes larger than the lean delay time period (TDR1>('TDL1)), the controlled air-fuel ratio becomes richer, and if the lean delay time period becomes larger than the rich delay time period ((−TDL1)>TDR1), the controlled air-fuel ratio becomes leaner. Thus the air-fuel ratio can be controlled by changing the rich delay time period TDR1 and the lean delay time period (−TDL1) in accordance with the output of the downstream-side $O_2$ sensor 15. Also, if the rich skip amount RSR is increased or if the lean skip amount RSL is decreased, the controlled airfuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output of the downstream-side $O_2$ sensor 15. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $V_{R1}$ is increased, the controlled air-fuel ratio becomes richer, and if the reference voltage VR1 is decreased, the controlled air-fuel ratio becomes leaner. Thus, the air-fuel ratio can be controlled by changing the reference voltage $V_{R1}$ in accordance with the output of the downstream-side $O_2$ sensor 15.

Figure 7:
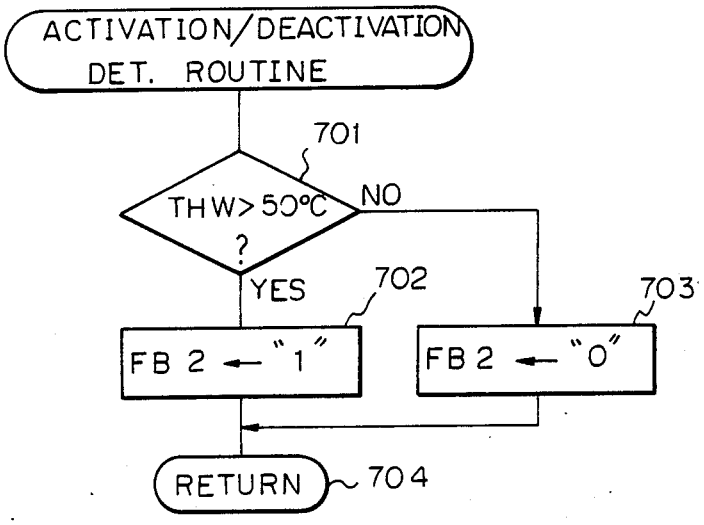

FIG. 7 is a routine for determining whether the downstream-side $O_2$ sensor 15 is activated or deactivated, and is executed at a predetermined time period such as every 50 ms. At step 701, the coolant temperature THW is fetched, and it is determined whether or not the coolant temperature THW is higher than a predetermined temperature such as 50° C. As a result, if THW>50° C., the control proceeds to step 702 which sets an air-fuel ratio feedback control execution flag FB2, and if THW≦50° C., the control proceeds to step 703 which clears the air-fuel ratio feedback control execution flag FB2. The air-fuel ratio feedback control execution flag FB2 is then stored in the RAM 106, thereby completing this routine at step 704.

Thus, according to the routine of FIG. 7, the activation/deactivation of the downstream-side $O_2$ sensor 15 is determined by the coolant temperature THW.

Figures 8, 8A:
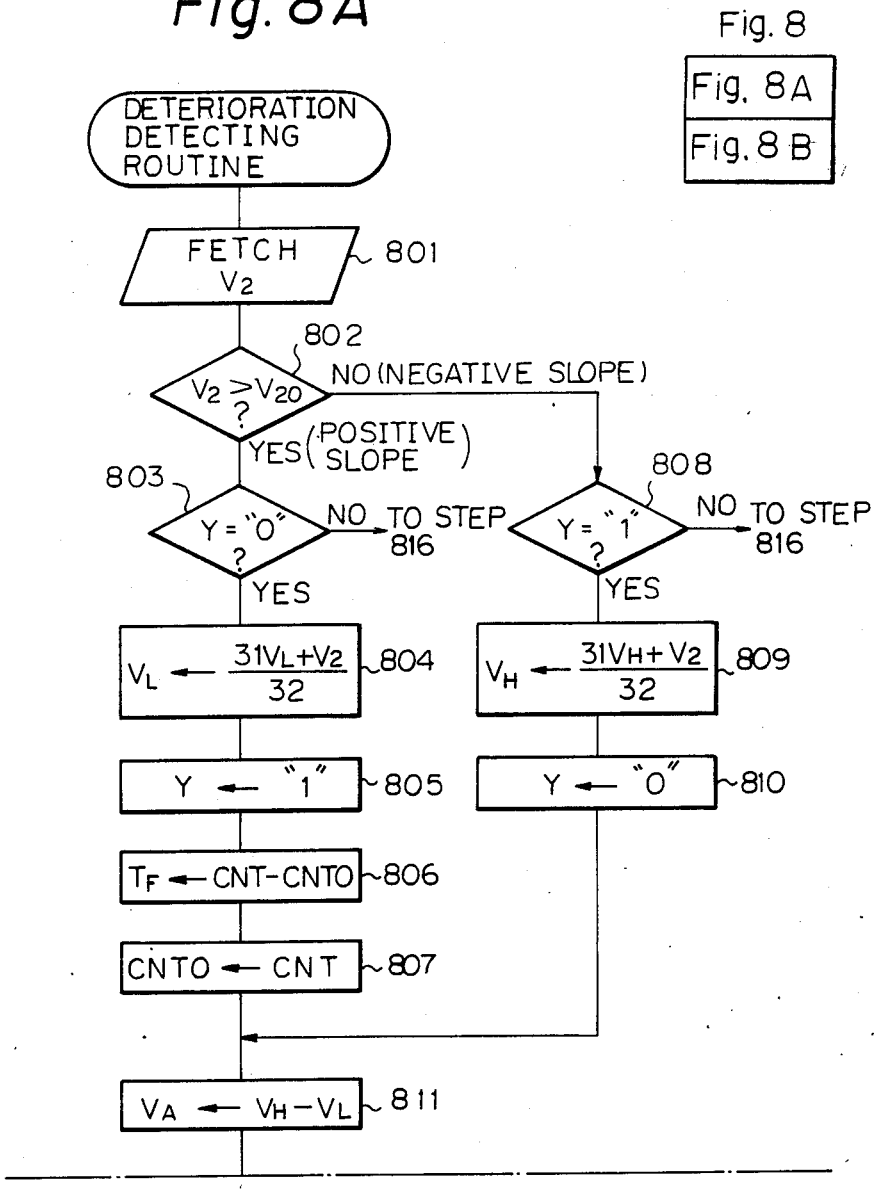
Figure 9A:
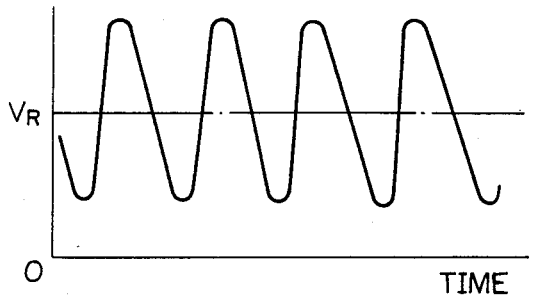
FIGS. 9A and 9B are timing diagrams of examples of the output of an $O_2$ sensor.
Figure 9B:
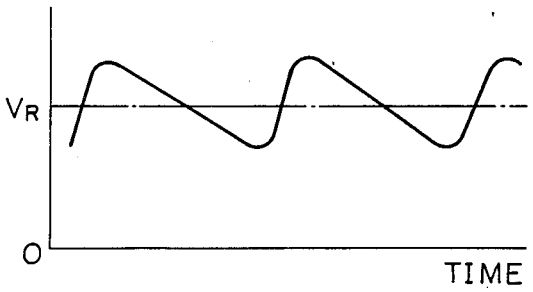
Figure 10:
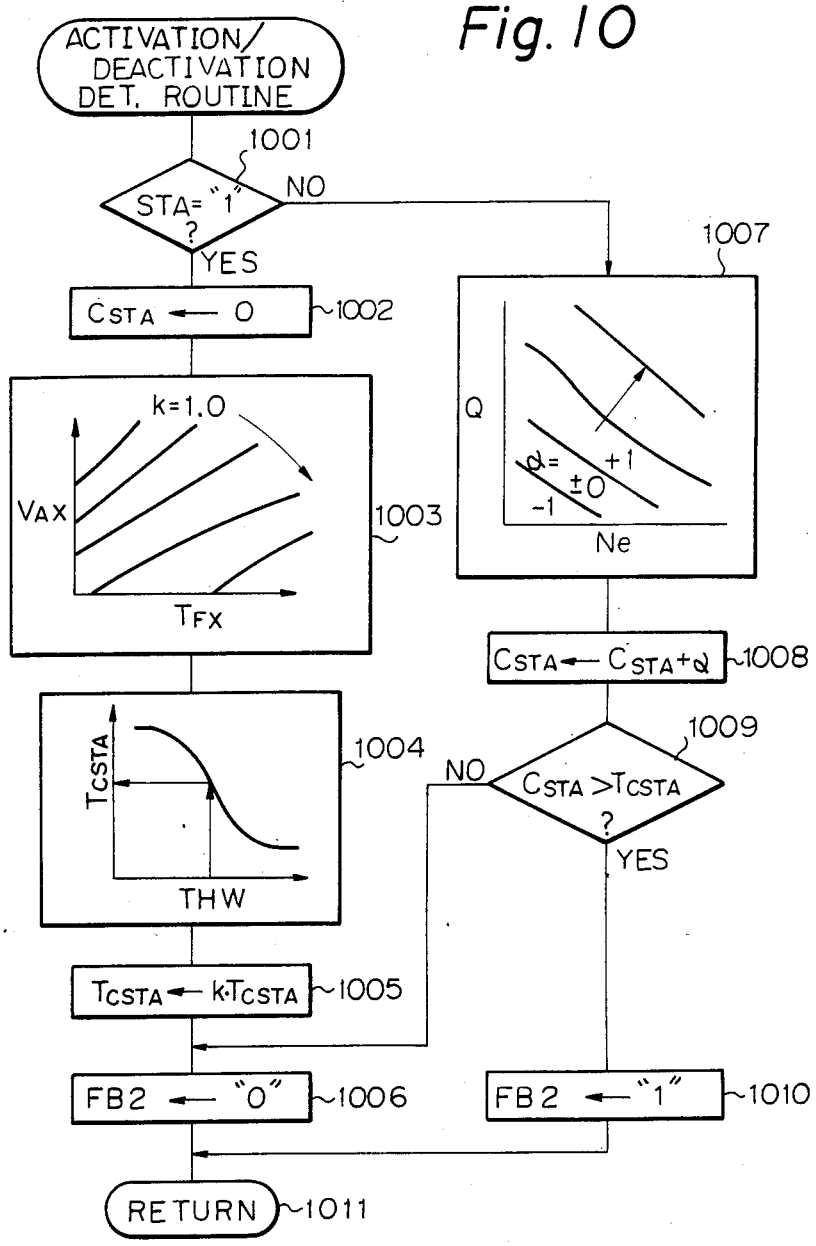

FIGS. 8 and 10 are also routines for determining whether the downstream-side $O_2$ sensor 15 is activated or deactivated. In more detail, FIG. 8 is a routine for detecting the deterioration degree of the downstream-side $O_2$ sensor 15, executed at a predetermined time period such as every 4 ms, and FIG. 10 is a routine for determining whether the downstream-side $O_2$ sensor 15 is activated or deactivated, executed at a predetermined crank angle such as every 360° CA. Note that the routine of FIG. 8 is carried out only when the feedback conditions by the downstream-side $O_2$ sensor 15 are satisfied. That is, in the three-way reducing and oxidizing catalysts, when a lean air-fuel ratio atmosphere prevails, $O_2$ is absorbed thereinto, and when a rich air-fuel ratio atmosphere prevails, HC and CO are absorbed thereinto, and are reacted with the absorbed $O_2$ This is a so-called $O_2$ storage effect. An air-fuel feedback control operation provides an optimum frequency and amplitude of the air-fuel ratio thereby positively making use of such an $O_2$ storage effect. Therefore, according to the air-fuel feedback control, if an $O_2$ sensor such as the downstream-side $O_2$ sensor 15 is not deteriorated, the output thereof is swung as shown in FIG. 9A. Contrary to the above, when the $O_2$ sensor is deteriorated, only a little oxygen penetrates the zirconia elements of the $O_2$ sensor. As a result, when the exhaust gas is changed from a rich state to a lean state, the change of the output of the $O_2$ sensor from a rich signal to a lean signal is delayed, so that a time period of change of the output of the $O_2$ sensor from maximum to minimum becomes long. That is, before the output of the $O_2$ sensor becomes sufficiently low, the controlled air-fuel ratio is reversed. As a result, the frequency of the controlled air-fuel ratio is reduced as shown in FIG. 9B, thereby reducing the $O_2$ storage effect of the three way catalysts. Thus, when the $O_2$ sensor is further deteriorated, the frequency and amplitude of the $O_2$ sensor are both reduced.

In FIG. 8, at step 801, an A/D conversion is performed upon the output $V_2$ of the downstream-side $O_2$ sensor 15, and at step 802, it is determined whether or not $V_2 > V_{20}$ is satisfied. Here, $V_{20}$ is a value of the output $V_2$ previously fetched by this routine. If $V_2 > V_{20}$ (positive slope), the control proceeds to step 803 which determines whether or not a slope flag Y is "0", and if $V_2 \leqq V_{20}$ (negative slope), the control proceeds to step 808 which determines whether or not the slope flag Y is "1". Here, the slope flag Y (="1") shows that the output $V_2$ of the downstream-side $O_2$ sensor 15 is being increased. Therefore, at step 803, if Y="0", this means that the output $V_2$ of the downstream-side $O_2$ sensor 15 is reversed from the decrease side to the increase side, and if Y="1", this means that the output $V_2$ of the downstream-side $O_2$ sensor 15 is being increased. On the other hand, at step 808, if Y="1", this means that the output $V_2$ of the downstream-side $O_2$ sensor 15 is reversed from the increase side to the decrease side, and if Y="0", this means that the output $V_2$ of the downstream-side $O_2$ sensor 15 is being decreased.

At step 803, when Y="0", i.e., when the output $V_2$ of the downstream-side $O_2$ sensor 15 is switched from the decrease side to the increase side, this means that the output $V_2$ has reached a minimum voltage. Therefore, in this case, the control proceeds to step 804 which renews a minimum voltage $V_L$ by $$V_L \leftarrow \frac{31V_L + V_2}{32}.$$

Then, at step 805, the slop flag Y is set. Next, at step 806, the current time CNT is read out of the freerun counter 104, and a time period of one cycle $T_F$ is calculated by $$T_F \leftarrow CNT - CNT0$$

where CNT0 is the time CNT of the freerun counter 104 when the output $V_2$ of the downstream-side $O_2$ sensor 15 has reached a previous minimum voltage. Then, at step 807, in order to prepare for detection of a next minimum voltage, the previous time CNT0 is replaced by the current time CNT. Note that, when Y="1" at step 803, so that the output $V_2$ of the downstream-side $O_2$ sensor 15 is increased, the control proceeds directly to step 816, and thus, the minimum voltage $V_L$ is not renewed, and the time period $T_F$ of one cycle is not calculated.

On the other hand, at step 808, when Y="1", i.e., when the output $V_2$ of the downstream-side $O_2$ sensor 15 is switched from the increase side to the decrease side, this means that the output $V_2$ has reached a maximum voltage. Therefore, in this case, the control proceeds to step 809 which renews a maximum voltage $V_H$ by $$V_H \leftarrow \frac{31V_H + V_2}{32}.$$

Then, at step 810, the slope flag Y is reset. Note that, when Y="0" at step 808, so that the output $V_2$ of the downstream-side $O_2$ sensor 15 is decreased, the control proceeds directly to step 816, and thus, the maximum voltage $V_H$ is not renewed.

At step 811, the amplitude $V_A$ of the output $V_2$ of the downstream-side $O_2$ sensor 15 is calculated by $$T_A \leftarrow V_H - V_L.$$

Then , at step 812, a blunt value $V_{AX}$ of the amplitude $V_{AX}$ is calculated by $$V_{AX} \leftarrow \frac{31V_{AX} + V_A}{32}.$$

This blunt value $V_{AX}$ is stored in the backup RAM 107 at step 813.

At step 814, a blunt value $T_{FX}$ of the time period $T_F$ is calculated by $$T_{FX} \leftarrow \frac{31T_{FX} + T_F}{32}$$

This blunt value $T_{FX}$ is stored in the backup RAM 107 at step 815.

At step 816, in order to prepare a next operation of this routine, the previous value $V_{20}$ is replaced by the current value $V_2$, and this routine is completed by step 817.

Thus, the amplitude $V_{AX}$ and time period $T_{FX}$ of the output $V_2$ of the downstream-side $O_2$ sensor 15 is obtained.

In FIG. 10, at step 1001, it is determined whether or not the starter switch 16 is turned ON, i.e., the engine is being started. If the engine is being started, the control proceeds to step 1002 which clears a counter $C_{STA}$, at step 1003, a parameter k corresponding to the deterioration degree of the downstream-side $O_2$ sensor 15 is calculated from a two-dimensional map stored in the ROM 105 using the amplitude $V_{AX}$ and the time period $T_{FX}$ of one cycle stored in the backup RAM 107. That is, when the downstream-side $O_2$ sensor 15 is deteriorated, the parameter k is increased.

At step 1004, the coolant temperature THW is read out of the RAM 106, and a reference time period $T_{CSTA}$ is calculated from a one-dimensional map stored in the ROM 105 using the coolant temperature THW stored in the RAM 106. That is, when the coolant temperature THW is increased, the reference time period $T_{CSTA}$ is decreased. Then, at step 1005, the reference time period $T_{CSTA}$ is corrected by multiplying it by the parameter k. That is, when the deterioration of the downstream-side $O_2$ sensor 15 is enhanced, the activation of the downstream-side $O_2$ sensor 15 is delayed, and therefore, the start of the feedback control is delayed. Then, at step 1006, the feedback control execution flag FB2 is reset, and this routine is completed by step 1011.

Next, when the starter (not shown) is turned OFF, the flow at steps 1002 to 1005 is switched to the flow at steps 1007 to 1009. At step 1007, a rate $\alpha$ for counting up a counter $C_{STA}$ is calculated in accordance with the engine state. In this case, the rate $\alpha$ is calculated from a two-dimensional map stored in the ROM 105 using the intake air amount Q (the intake air pressure PM, or the throttle opening TA) and the engine speed $N_e$ stored in the RAM 106. For example, when the engine is in a high load state at a high speed, so as to enhance the activation of the downstream-side $O_2$ sensor 15, the rate $\alpha$ is increased. Contrary to this, when the engine is in an idling state, so as to cool or deactivate the downstream-side $O_2$ sensor 15, the rate $\alpha$ is decreased, or made negative. At step 1008, the counter $C_{STA}$ is initiated to count up or down. In this case, since $C_{STA} < T_{CSTA}$, the control proceeds to step 606 which clears the feedback control execution flag FB2.

Next, when the counter $C_{STA}$ reaches $T_{CSTA}$, the flow at step 1009 proceeds to step 1010 which sets the feedback control execution flag FB2.

Note that, in FIG. 10, the reference time period $T_{CSTA}$ is calculated in accordance with the coolant temperature THW immediately after the engine is started. However, since the coolant temperature sensor 8 is usually located at an outlet portion of the water jacket 8, the reference time period $T_{CSTA}$ can be calculated in accordance with the coolant temperature THW after a predetermined time period such as several seconds has passed from the starting of the engine, in view of the difference in temperature characteristics between the outlet portion and the cylinder block.

If the engine is stopped for a relatively short time period such as 5 to 10 minutes after the engine has warmed-up, and the engine is then restarted, the coolant temperature THW is sufficiently high, but the sensed temperature of the downstream-side $O_2$ sensor 15 is low. Therefore, in this state, when the feedback control by the downstream-side $O_2$ sensor 15 is carried out in accordance with the coolant temperature THW, this feedback control by the downstream-side $O_2$ sensor 15 is started under the condition that the sensed temperature of the downstream-side $O_2$ sensor 15 is low, so that the output thereof is inclined to the rich side or the lean side, thus deteriorating the fuel consumption, the drivability, and the exhaust emissions. According to the routines of FIGS. 8 and 10, the activation/deactivation of the downstream-side $O_2$ sensor 15 is determined in accordance with the elapsed time period $T_{CSTA}$ dependent upon the coolant temperature THW. Therefore, immediately the engine is restarted at a high temperature ("hot start"), a feedback control by the downstream-side $O_2$ sensor 15 is not started even though the coolant temperature THW is high.

Figure 11:
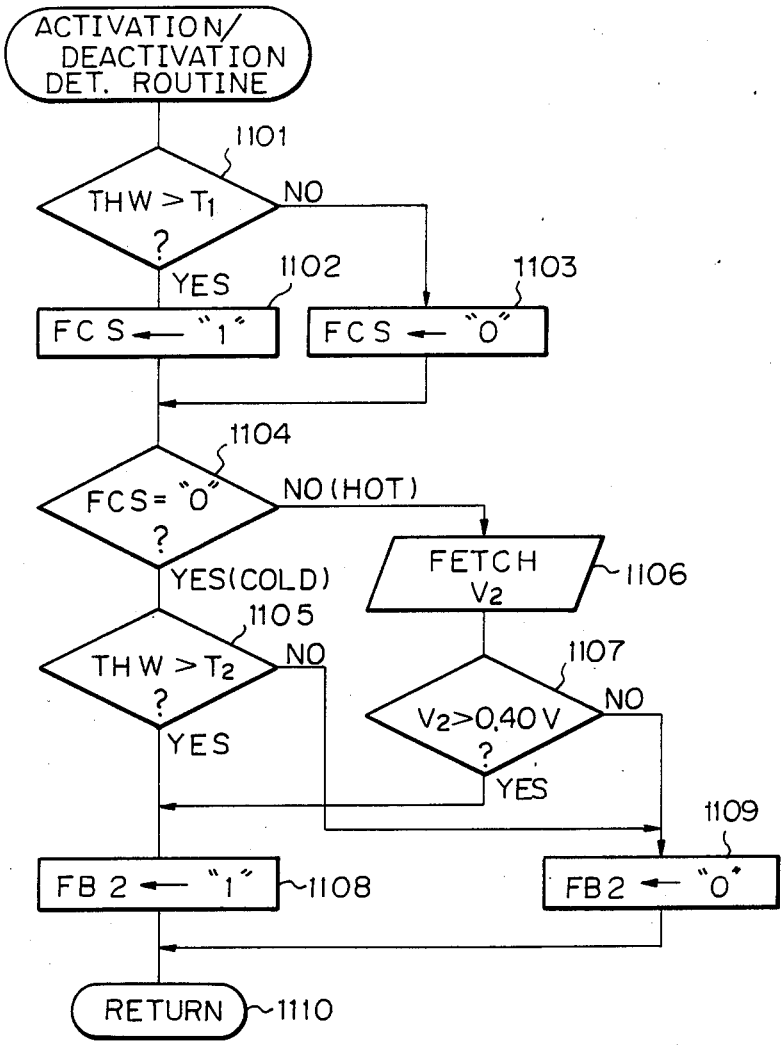

FIG. 11 is a further routine for determining whether the downstream-side $O_2$ sensor 15 is activated or deactivated, and is executed at a predetermined time period such as every 0.1 s. That is, at step 1101, the coolant temperature THW is read out of the RAM 106, and it is determined whether or not the coolant temperature THW is higher than a predetermined temperature $T_1$ such as 80° C. If $THW > T_1$, the control proceeds to step 1102 which sets a hot start flag FCS, and if $THW \leqq T_1$, the control proceeds to step 1103 which clears the hot start flag FCS. Thus, at steps 1101 through 1103, it is determined whether the engine is started at a high temperature or at a low temperature, and once it is determined that the engine is started at a high temperature, the hot start flag FCS is set.

If the engine is started at a low temperature ("cold start"), the control proceeds via step 1104 to step 1105 which determines whether or not the coolant temperature THW is higher than a predetermined temperature $T_2$ such as 70° C. Note that the predetermined temperature $T_2$ is lower than the predetermined temperature $T_1$. If $THW > T_2$, the control proceeds to step 1108 which sets the feedback control execution flag FB2, and if $THW \leqq T_2$, the control proceeds to step 1109 which clears the feedback control execution flag FB2. Thus, if the engine is started at a low temperature, the activation/deactivation of the downstream-side $O_2$ sensor 15 is determined in accordance with the coolant temperature THW.

On the other hand, if the engine is started at a high temperature ("hot start"), the control proceeds via step 1104 to step 1106 which performs an A/D conversion upon the output $V_2$ of the downstream-side $O_2$ sensor 15, and determines whether or not this output $V_2$ is higher than a predetermined voltage such as 0.40 V. As a result, if $V_2 > 0.40$ V, the control proceeds to step 1108 which sets the feedback control execution flag FB2, and if $V_2 \leqq 0.40$ V, the control proceeds to step 1109 which clears the feedback control execution flag FB2. Thus, if the engine is started at a high temperature, the activation/deactivation of the downstream-side $O_2$ sensor 15 is determined in accordance with the output $V_2$ of the downstream-side $O_2$ sensor 15.

According to the routine of FIG. 11, the activation/-deactivation of the downstream-side $O_2$ sensor 15 is accurately determined for a "hot start" and a "cold start".

A double $O_2$ sensor system into which a second air-fuel ratio correction amount FAF2 is introduced will be explained with reference to FIGS. 12 and 13.

Figures 12, 12A:
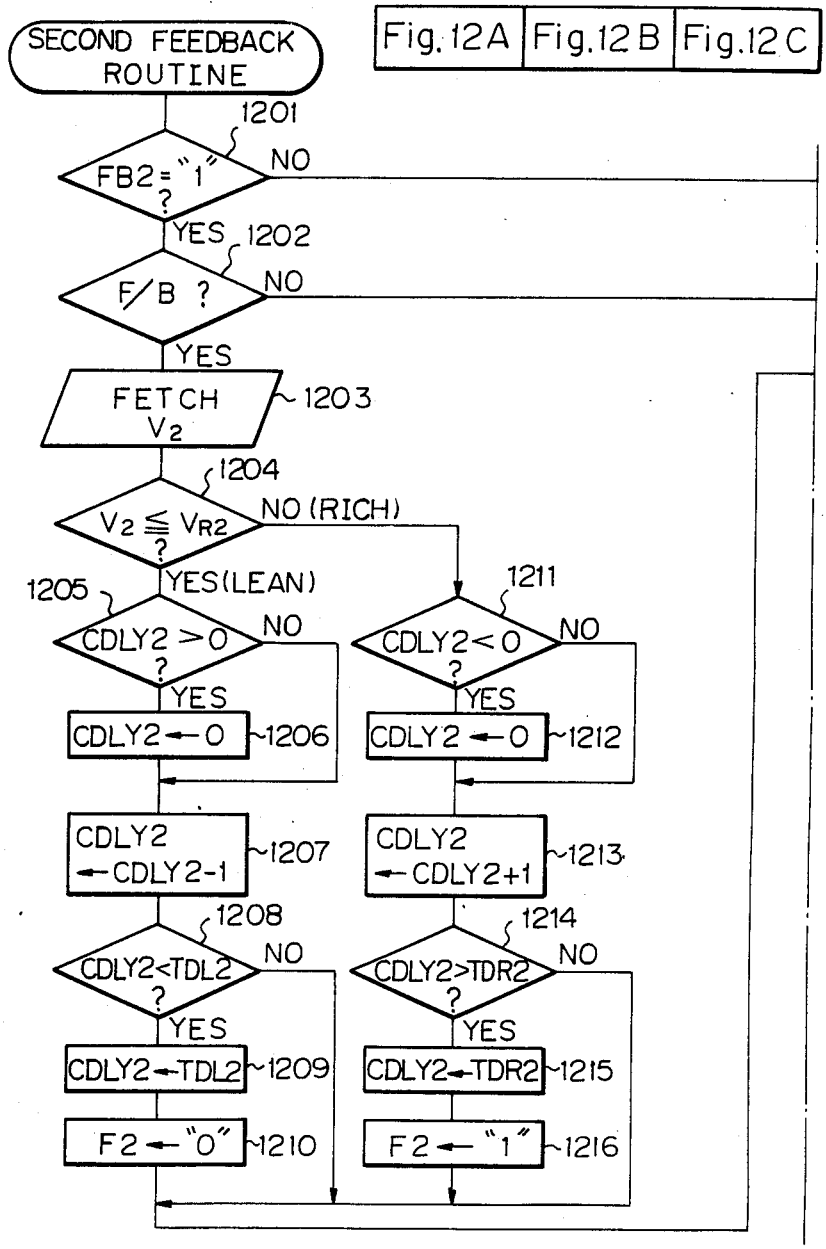
Figure 12B:
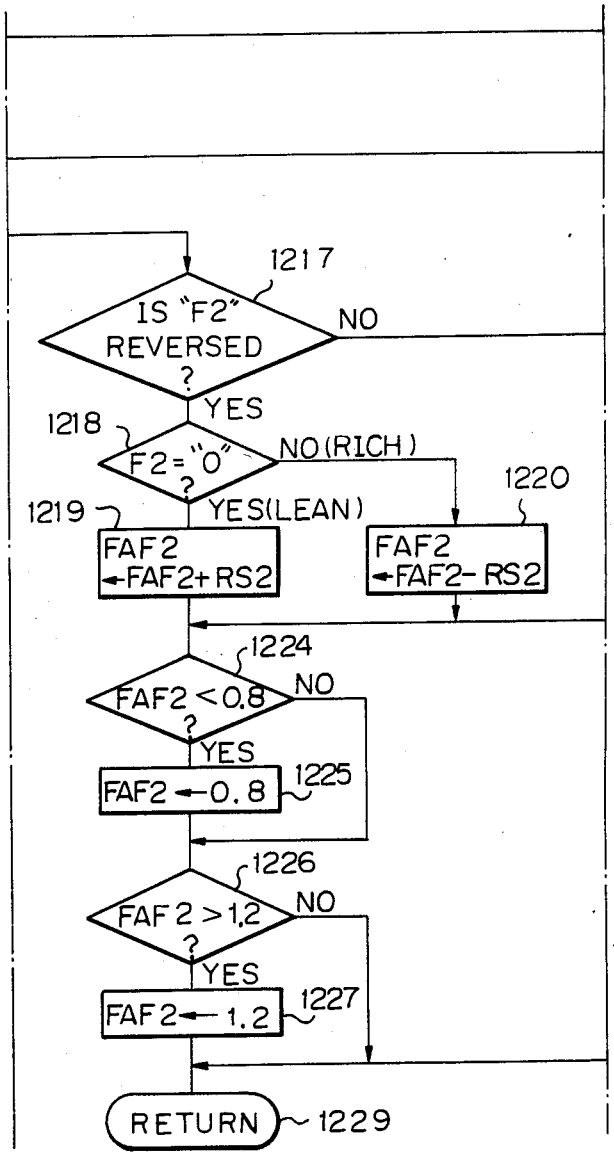
Figure 12C:
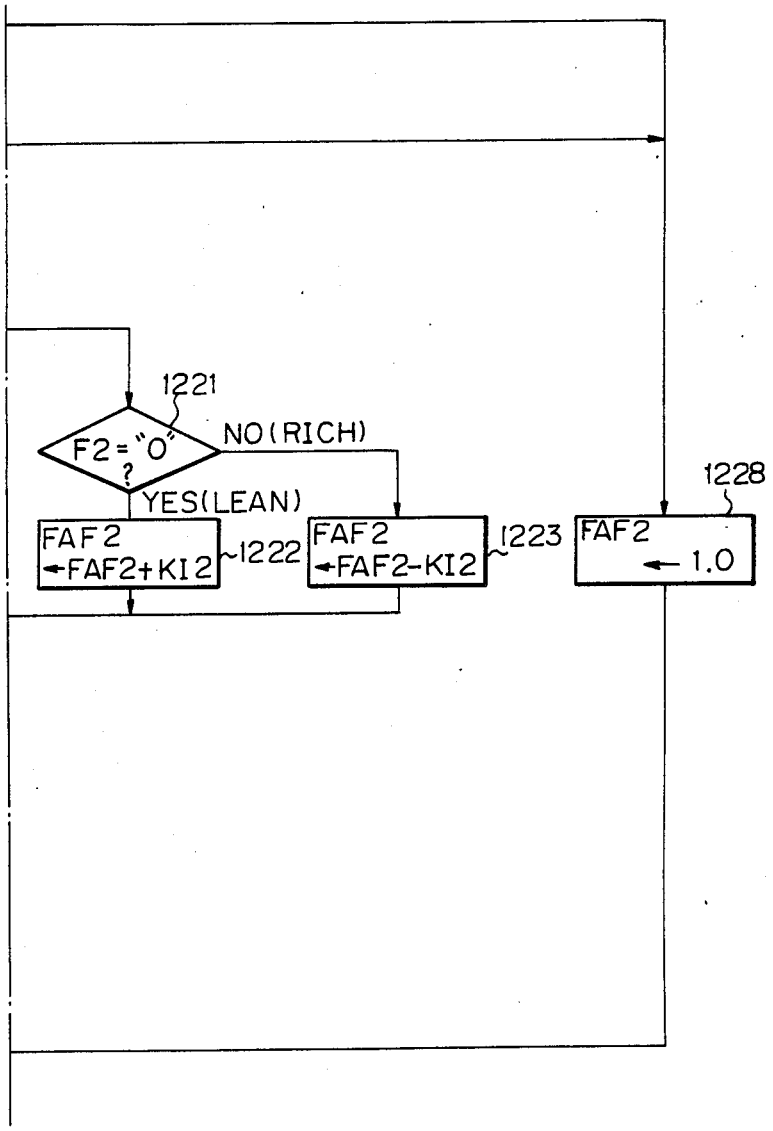

FIG. 12 is a routine for calculating a second air-fuel ratio feedback correction amount FAF2 in accordance with the output of the downstream-side $O_2$ sensor 15 executed at every predetermined time period such as 1 s.

At step 1201, it is determined whether or not the feedback control execution flag FB2 calculated by the routine of FIGS. 7, 10, or 11 is "1". If FB2 ="0", the control proceeds to step 1228 which causes the second feedback correction amount FAF2 to be 1.0 (FAF2=1.0), thereby carrying out an open-loop control operation. Note that, also in this case, the correction amount FAF2 can be a learning value or a value immediately before the feedback control by the downstream-side $O_2$ sensor 15 is stopped.

Also, if FB2="1", the control proceeds to step 1202 which determines whether or not all the feedback control (closed-loop control) conditions by the downstream-side $O_2$ sensor 15 are satisfied. The feedback control conditions are as follows:

(i) the engine is not in a starting state;

(ii) the coolant temperature THW is higher than 50° C.; and (iii) the power fuel incremental amount FPOWER is 0.

Of course, other feedback control conditions are introduced as occasion demands. However, an explanation of such other feedback control conditions is omitted.

If one or more of the feedback control conditions is not satisfied, the control also proceeds to step 1228, thereby carrying out an open-loop control operation.

Contrary to the above, at step 1202, if all of the feedback control conditions are satisfied, the control proceeds to step 1203.

At step 1203, an A/D conversion is performed upon the output voltage $V_2$ of the downstream-side $O_2$ sensor 15, and the A/D converted value thereof is then fetched from the A/D converter 101. Then, at step 1204, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12.

Steps 1205 through 1216 correspond to step 504 through 515, respectively, of FIG. 5, thereby performing a delay operation upon the determination at step 1204. Here, a rich delay time period is defined by TDR2, and a lean delay time period is defined by TDL2. As a result of the delayed determination, if the air-fuel ratio is rich a second air-fuel ratio flag F2 is caused to be "1", and if the air-fuel ratio is lean, a second air-fuel ratio flag F2 is caused to be "0".

Next, at step 1217, it is determined whether or not the second air-fuel ratio flag F2 is reversed, i.e., whether or not the delayed air-fuel ratio detected by the downstream-side $O_2$ sensor 15 is reversed. If the second air-fuel ratio flag F2 is reversed, the control proceeds to steps 1218 to 1220 which carry out a skip operation. That is, if the flag F2 is "0" (lean) at step 1218, the control proceeds to step 1219, which remarkably increases the second correction amount FAF2 by skip amount RS2. Also, if the flag F2 is "1" (rich) at step 1218, the control proceeds to step 1220, which remarkably decreases the second correction amount FAF2 by the skip amount RS2. On the other hand, if the second air-fuel ratio flag F2 is not reversed at step 1217, the control proceeds to steps 1221 to 1223, which carries out an integration operation. That is, if the flag F2 is "0" (lean) at step 1221, the control proceeds to step 1222, which gradually increases the second correction amount FAF2 by an integration amount KI2. Also, if the flag F2 is "1" (rich) at step 1221, the control proceeds to step 1223, which gradually decreases the second correction amount FAF2 by the integration amount KI2.

Note that the skip amount RS2 is larger than the integration amount KI2.

The second correction amount FAF2 is guarded by a minimum value 0.08 at steps 1224 and 1225, and by a maximum value 1.2 at steps 1226 and 1227, thereby also preventing the controlled air-fuel ratio from becoming overrich or overlean.

The correction amount FAF2 is then stored in the RAM 106, thus completing this routine of FIG. 12 at step 1229.

Figure 13:
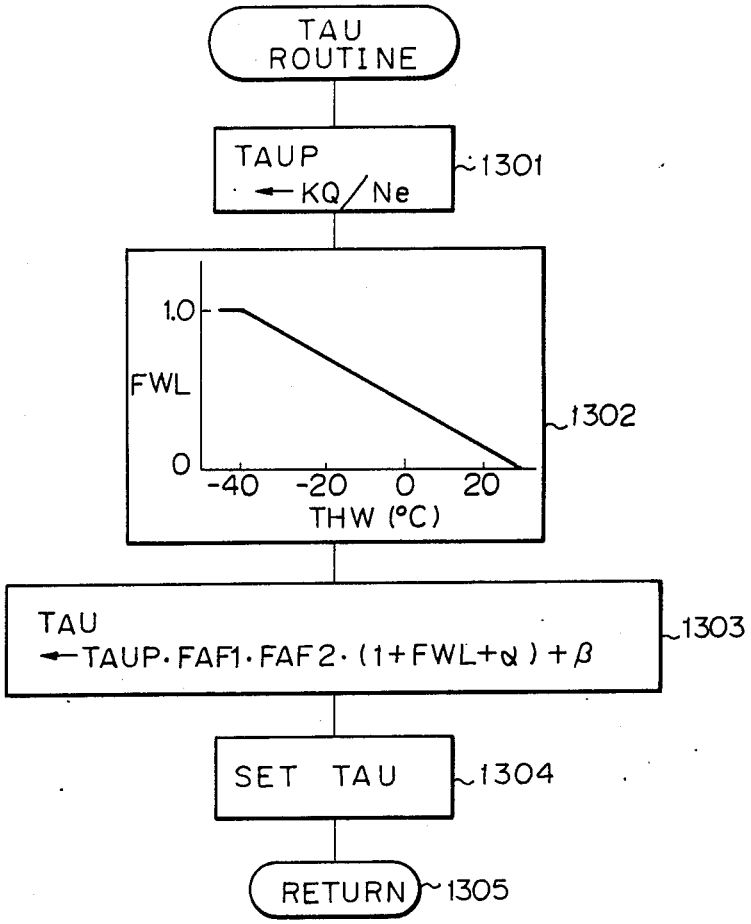

FIG. 13 is a routine for calculating a fuel injection amount TAU executed at every predetermined crank angle such as 360° CA. At step 1301, a base fuel injection amount TAUP is calculated by using the intake air amount data Q and the engine speed data Ne stored in the RAM 106. That is, $$TAUP \leftarrow KQ/Ne$$

where K is a constant. Then at step 1302, a warming-up incremental amount FWL is calculated from a one-dimensional map stored in the ROM 105 by using the coolant temperature data THW stored in the RAM 106. Note that the warming-up incremental amount FWL decreases 1203, a final fuel injection amount TAU is calculated by $$TAU \leftarrow TAUP \cdot FAF1 \cdot FAF2\ (1+FWL+\alpha)+\beta$$

Where $\alpha$ and $\beta$ are correction factors determined by other parameters such as the voltage of the battery and the temperature of the intake air. At step 1204, the final fuel injection amount TAU is set in the down counter 108, and in addition, the flip-flop 109 is set initiate the activation of the fuel injection valve 7. Then, this routine is completed by step 1205. Note that, as explained above, when a time period corresponding to the amount TAU passes, the flip-flop 110 is reset by the carry-out signal of the down counter 109 to stop the activation of the fuel injection valve 7.

Figure 8B:
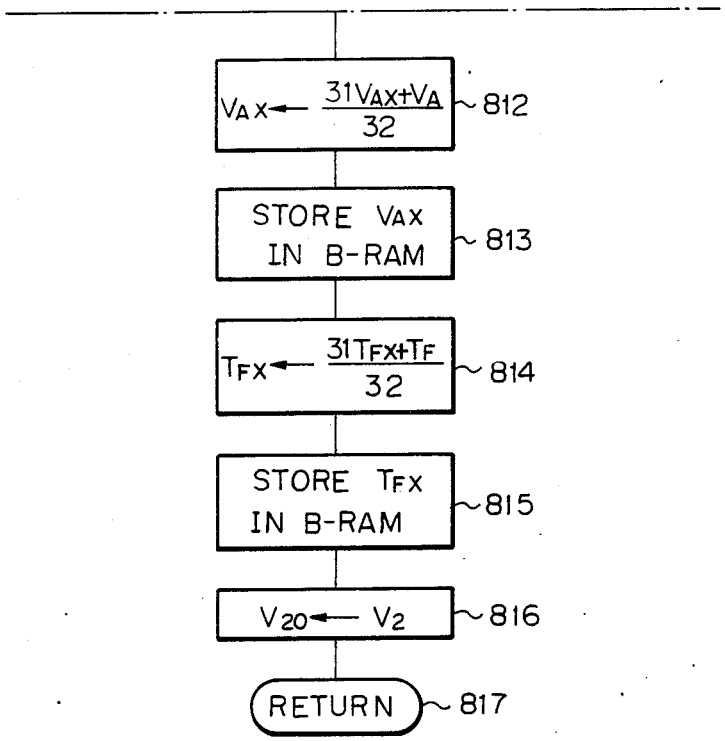
Figures 14A, 14B, 14C, 14D, 14E, 14F, 14G, 14H:
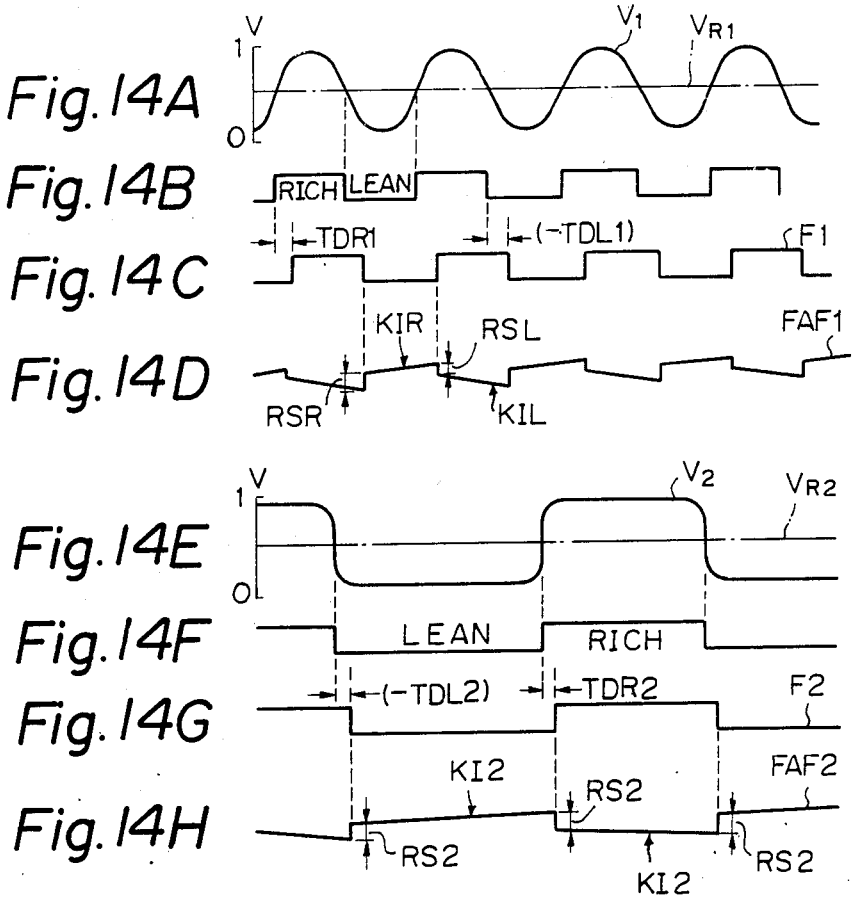
FIGS. 14A through 14H are timing diagrams explaining the flow charts of FIGS. 5, 7 (8, 10, 11) 12, and 13.

FIGS. 14A through 14H are timing diagrams for explaining the two air-fuel ratio correction amounts FAF1 and FAF2 obtained by the flow charts of FIGS. 5, 12, and 13. In this case, the engine is in a closed-loop control state for the two $O_2$ sensors 13 and 15. When the output of the upstream-side $O_2$ sensor 13 is changed as illustrated in FIG. 14A, the determination at step 503 of FIG. 5 is shown in FIG. 14B, and a delayed determination thereof corresponding to the first air-fuel ratio flag F1 is shown in FIG. 14C. As a result, as shown in FIG. 14D, every time the delayed determination is changed from the rich side to the lean side, or vice versa, the first air-fuel ratio correction amount FAF1 is skipped by the skip amount RSR or RSL. On the other hand, when the output of the downstream-side $O_2$ sensor 15 is changed as illustrated in FIG. 14E, the determination at step 1203 of FIG. 12 is shown in FIG. 14F, and the delayed determination thereof corresponding to the second air-fuel ratio flag F2 is shown in FIG. 14G. As a result, as shown in FIG. 14H, every time the delayed determination is changed from the rich side to the lean side, or vice versa, the second air-fuel ratio correction amount FAF2 ia skipped by the skip amount RS2. As a result, for a time period of from time $t_0$ to time $t_1$ at which the counter C reaches $\alpha$, the second air-fuel ratio correction amount FAF2 is increased at the integration speed of 3KI2, and subsequently, the second air-fuel ratio correction amount FAF2 is increased at the integration speed of KI2. As a result, the second air-fuel ratio correction amount FAF2 promptly reaches a desired level, and accordingly, the controlled air-fuel ratio reaches the optimum level such as the stoichiometric air-fuel ratio. Note that FIG. 8B illustrates the determination at step 509 of FIGS. 5 and 8C illustrates the second air-fuel ratio flag F2.

If the second air-fuel ratio correction amount FAF2 is increased at the integration speed of KI2 even after time $t_0$, the second air-fuel ratio correction amount FAF2 is changed as indicated by a dotted line in FIG. 8E, and therefore, a long period of time must elapse before the second air-fuel correction amount FAF2 reaches the desired level.

A double $O_2$ sensor system, in which an air-fuel ratio feedback control constant of the first air-fuel ratio feedback control by the upstream-side $O_2$ sensor is variable, will be explained with reference to FIGS. 15 and 16. In this case, the delay time periods TDR1 and TDL1 as the air-fuel ratio feedback control parameters are variable.

Figures 15, 15A:
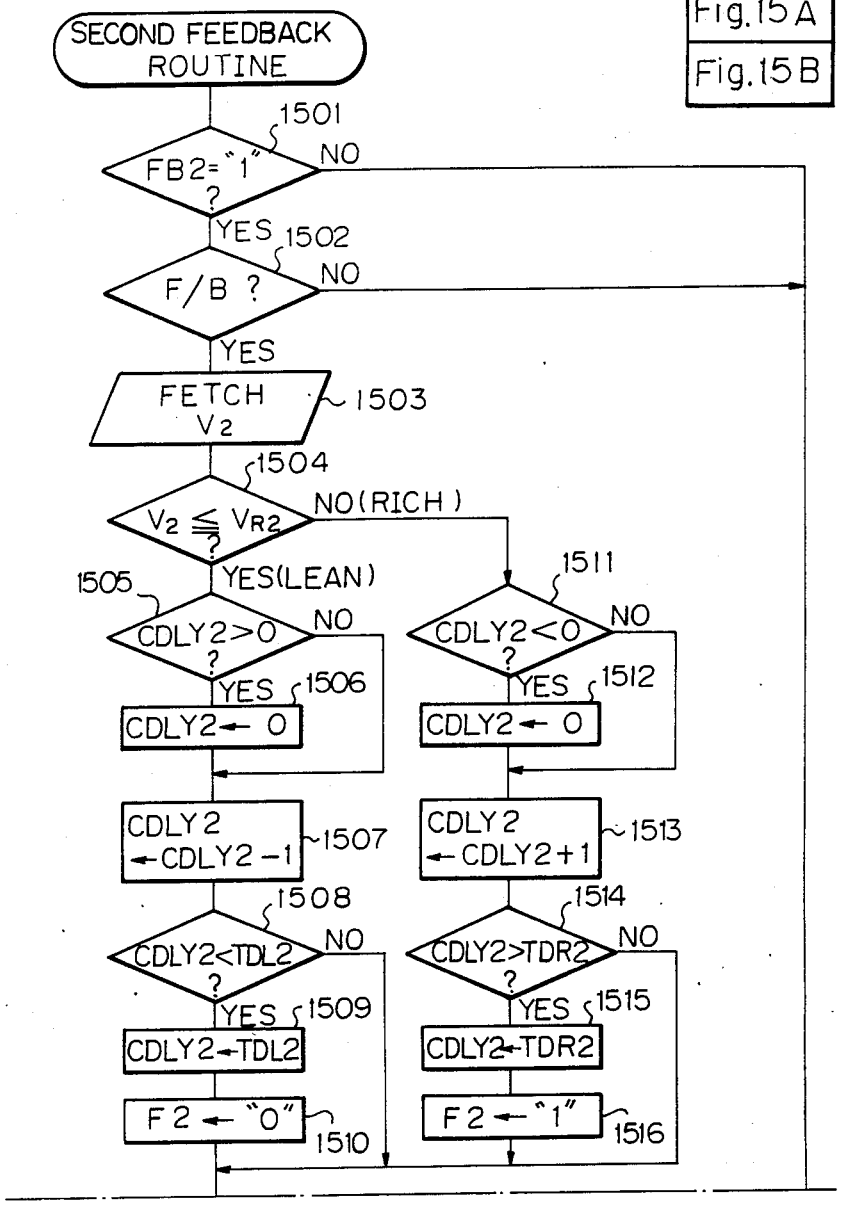
Figure 15B:
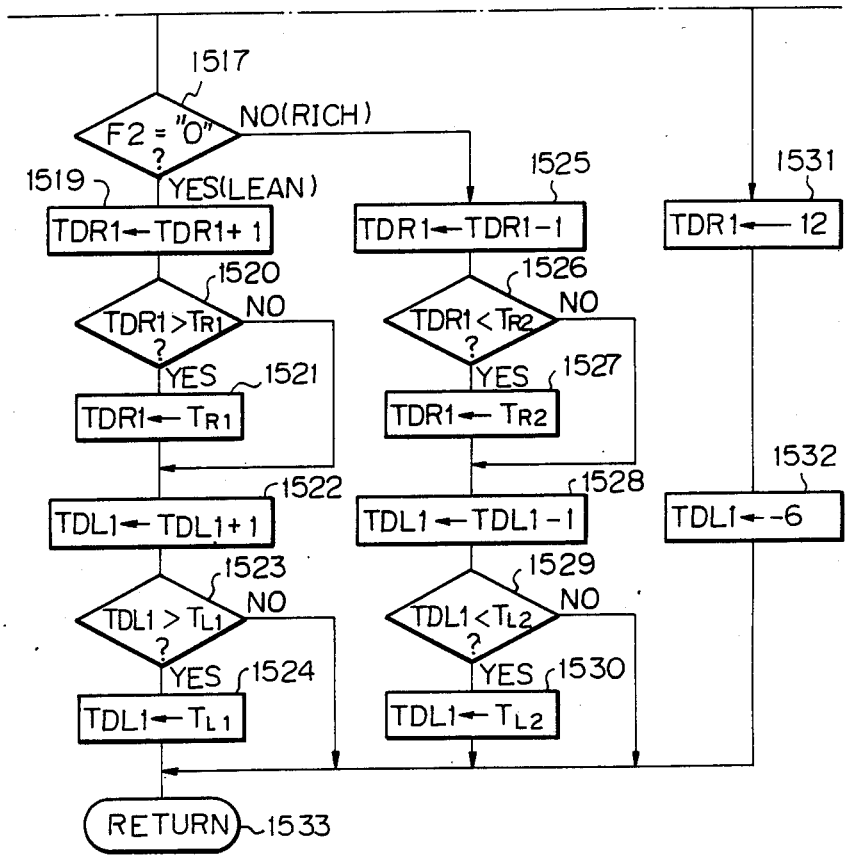

FIG. 15 is a routine for calculating the delay time periods TDR1 and TDL1 in accordance with the output of the downstream-side $O_2$ sensor 15 executed at every predetermined time period such as 1 s.

Steps 1501 through 1516 are the same as steps 1201 through 1216 of FIG. 12. That is, if FB2="0", or if one or more of the feedback control conditions is not satisfied, the control proceeds to step 1531 in which the rich delay time period TDR1 is caused to be a definite value such as 12 corresponding to 48 ms, and also proceeds to step 1532 in which the lean delay time period TDL1 is caused to be a definite value such as −6 corresponding to 24 ms, thereby carrying out an open-loop control for the downstream-side $O_2$ sensor 15. Note that the rich delay time period TDR1 is preferably larger than the lean delay time period (−TDL1), in consideration of the difference in output characteristics and deterioration speed between the $O_2$ sensor 13 upstream of the catalyst converter 12 and the $O_2$ sensor 15 downstream of the catalyst converter 12, so that the reference voltage $V_{R2}$ is higher than the reference voltage $V_{R1}$.

Contrary to the above, at steps 1501 and 1502, if FB2="1" and all of the feedback control conditions are satisfied, the control proceeds to step 1504.

Steps 1504 through 1516 correspond to steps 1204 through 1216, respectively, of FIG. 12. That is, when the engine is switched from an open-loop control to a closed-loop control, the flow at steps 1501 and 1502 proceeds to step 1503. At steps 1505 through 1516, a delay operation is performed upon the determination at step 1504. Here, a rich delay time period is defined by TDR2, and a lean delay time period is defined by TDL2. As a result of the delayed determination, if the air-fuel ratio is rich, a second air-fuel ratio flag F2 is caused to be "1", and if the air-fuel ratio is lean, the second air-fuel ratio flag F2 is caused to be "0".

At step 1517, it is determined whether or not the second air-fuel ratio F2 is "0". If F2="0", which means that the air-fuel ratio is lean, the control proceeds to steps 1519 through 1524, and if F2="1", which means that the air-fuel ratio is rich, the control proceeds to steps 1525 through 1530.

At step 1519, the rich delay time period TDR1 is increased by 1 to move the air-fuel ratio to the rich side. At steps 1520 and 1521, the rich delay time period TDR1 is guarded by a maximum value $T_{R1}$. Note that the value $T_{R1}$ is positive, and accordingly, the value $T_{R1}$ means a maximum rich delay time period. Further, at step 1522, the lean delay time period TDL1 is increased by 1 to move the air-fuel ratio to the rich side. At steps 1523 and 1524, the lean delay time period TDL1 is guarded by a maximum value $T_{L1}$. Note that the value $T_{L1}$ is negative, and accordingly, the value $T_{L1}$ means a minimum lean delay time period.

On the other hand, at step 1525, the rich delay time period TDR1 is decreased by 1 to move the air-fuel ratio to the lean side. At steps 1526 and 1527, the rich delay time period TDR1 is guarded by a minimum value $T_{R2}$. Note that the value $T_{R2}$ is also positive, and accordingly, the value $T_{R2}$ means a minimum rich delay time period. Further, at step 1528, the lean delay time period TDL1 is decreased by 1 to move the air-fuel ratio to the lean side. At steps 1529 and 1530, the lean delay time period TDL1 is guarded by a minimum value $T_{L2}$. Note that the value $T_{L1}$ is also negative, and accordingly, the value $(-T_{L2})$ means a maximum lean delay time period.

The delay time period TDR1 and TDL1 are then stored in the RAM 106, thereby completing this routine of FIG. 15 at step 1538.

Figure 16:
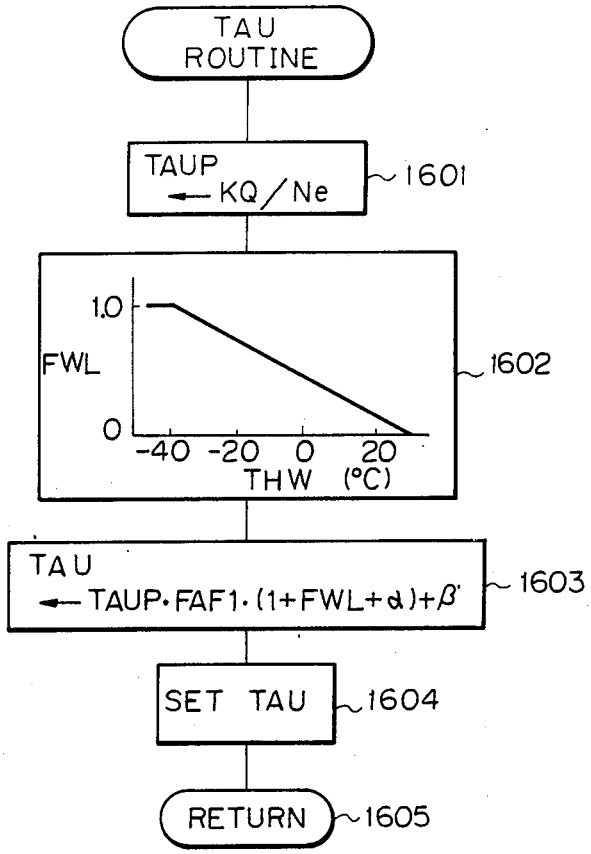

FIG. 16, is a routine for calculating a fuel injection amount TAU executed at every predetermined crank angle such as 360° CA. At step 1601, a base fuel injection amount TAUP is calculated by using the intake air amount data Q and the engine speed data Ne stored in the RAM 105. That is, $$TAUP \leftarrow KQ/Ne$$

where K is a constant. Then at step 1602, a warmingup incremental amount FWL is calculated from a onedimensional map by using the coolant temperature data THW stored in the RAM 106. Note that the warmingup incremental amount FWL decreases when the coolant temperature THW increases. At step 1603, a final fuel injection amount TAU is calculated by $$TAU \leftarrow TAUP \cdot FAF1 \cdot (1+FWL+\alpha)+\beta$$

where $\alpha$ and $\beta$ are correction factors determined by other parameters such as the voltage of the battery and the temperature of the intake air. At step 1604, the final fuel injection amount TAU is set in the down counter 109, and in addition, the flip-flop 110 is set to initiate the activation of the fuel injection valve 7. Then, this routine is completed by step 1605. Note that, as explained above, when a time period corresponding to the amount TAU has passed, the flip-flop 110 is reset by the carry-out signal of the down counter 109 to stop the activation of the fuel injection valve 7.

Figures 17A, 17B, 17C, 17D, 17E, 17F, 17G, 17H:
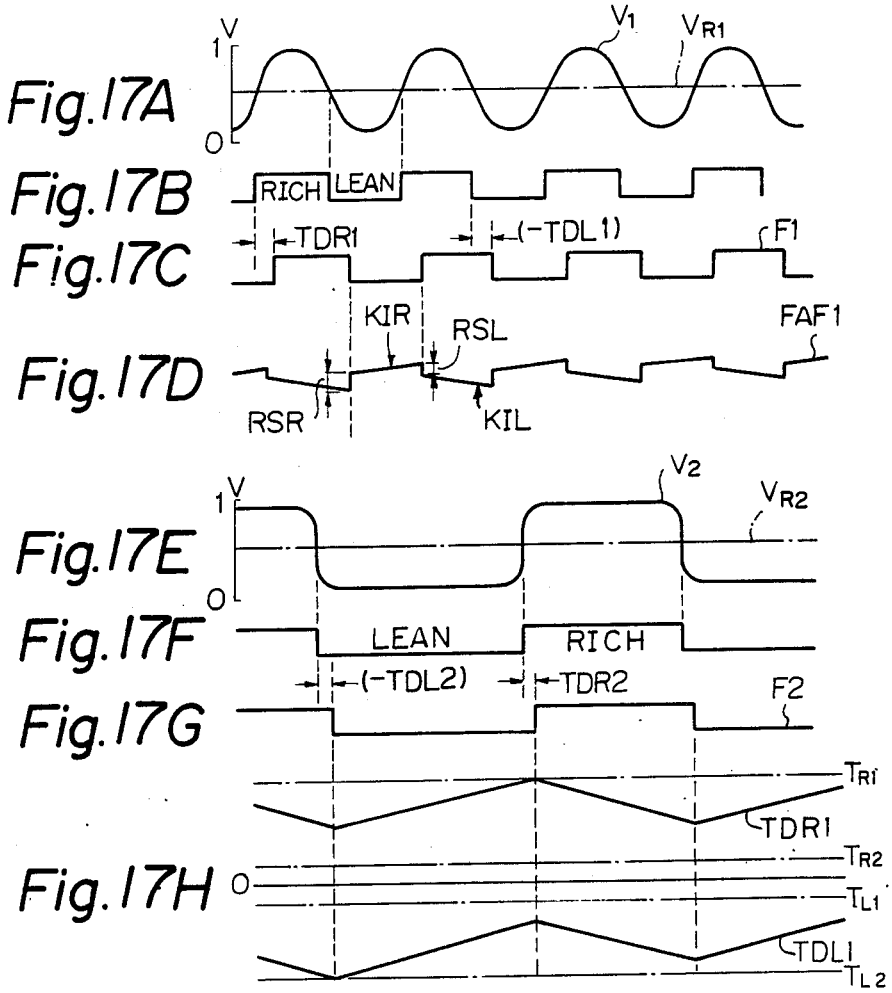
FIGS. 17A through 17H are timing diagrams explaining the flow charts of FIGS. 5, 7 (8, 10, 11), 15, and 16.

FIGS. 17A through 17H are timing diagrams for explaining the air-fuel ratio correction amount FAF1 and the delay time periods TDR1 and TRL1 obtained by the flow charts of FIGS. 5, 15, and 16. FIGS. 17A through 17F are the same as FIGS. 14A through 14F, respectively. As shown in FIGS. 17G and 17H, when the delayed determination F2 is lean, both of the delay time periods TDR1 and TDL1 are increased, and when the delayed determination F2 is rich both of the delay time periods TDR1 and TDL1 are decreased. In this case, the rich delay time period TDR1 is changed within a range of from $T_{R1}$ to $T_{R2}$, and the lean delay time period TRL1 is changed within a range of from $T_{L1}$ to $T_{L2}$.

Figure 18A:
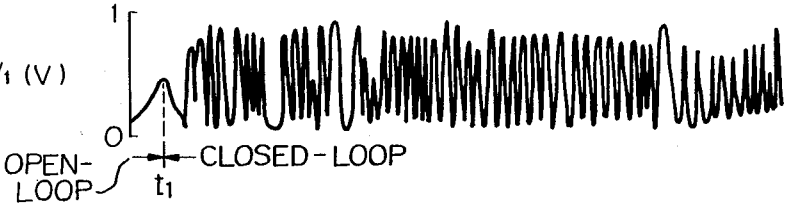
FIGS. 18A, 18B, and 18C, and FIGS. 19A through 19F are timing diagrams for explaining the effect of the present invention.
Figure 18B:
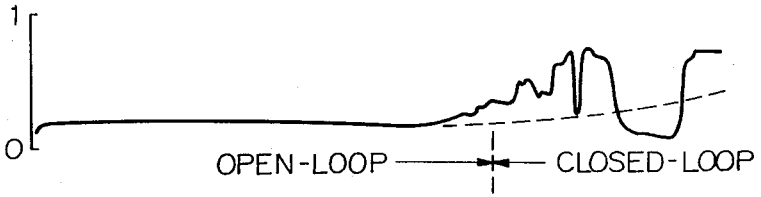
Figure 18C:
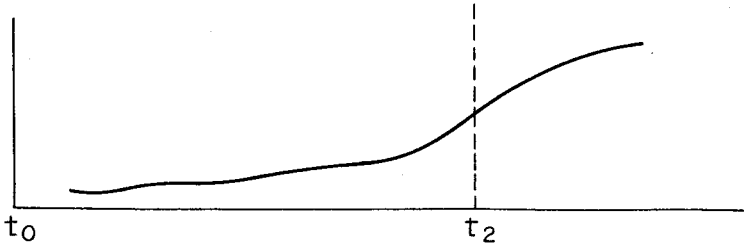

FIGS. 18A through 18C are timing diagrams for explaining the effect of the present invention using the activation/deactivation determining routine of FIG. 7. In FIGS. 18A and 18B, the outputs $V_1$ and $V_2$ of the $O_2$ sensors 13 and 15 are illustrated after time $t_0$ when the engine is started at a low temperature ("cold start"). In this case, the upstream-side $O_2$ sensor 13 is activated relatively early, but the downsteam-side $O_2$ sensor 15 is activated relatively slowly. That is, the control by the upstream-side $O_2$ sensor 13 is switched from an open-loop control operation to a closed-loop control at time $t_1$, while the control by the downstream-side $O_2$ sensor 15 is switched from an open-loop control operation to a closed-loop control operation. Therefore, only the closed-loop control by the upstream-side $O_2$ sensor 13 is carried out from time $t_1$ to time $t_2$. The timing $t_2$ when the control by downstream-side $O_2$ sensor 15 is switched from an open-loop control operation to a closed-loop control operation is determined by the coolant temperature THW. That is, the activation/deactivation of the downstream-side $O_2$ sensor 15 is determined by the coolant temperature THW. Therefore, in this case, the closed-loop operation by the downstream-side $O_2$ sensor 15 according to the present invention is initiated earlier than in the prior art. Also, when an idling state continues for a long time so that the downstream-side $O_2$ sensor 15 is cooled, the closed-loop operation by the downstream-side $O_2$ sensor 15 can be stopped.

Figures 19A, 19B, 19C, 19D, 19E, 19F:
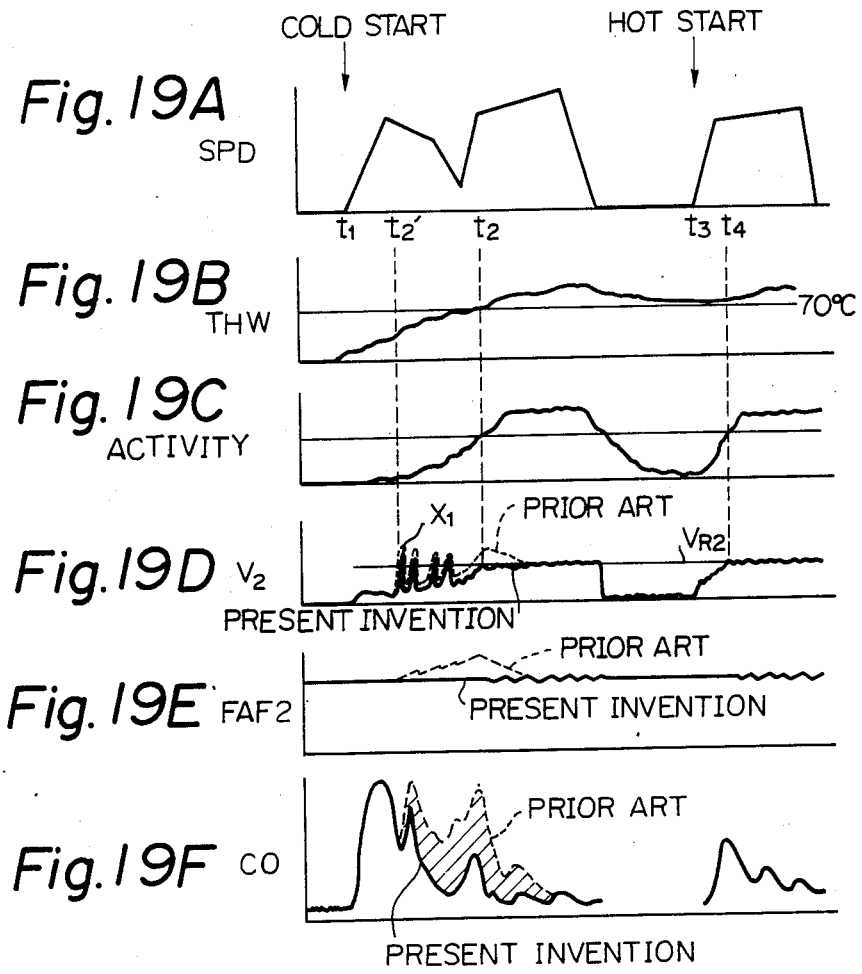
PRIOR ART Fig. 19E
PRIOR ART Fig. 19F

FIGS. 19A through 19F are timing diagrams for explaining the effect of the present invention using the activation/deactivation determining routine of FIG. 11. That is, at time $t_1$, when the engine is started at a low temperature ("cold start"), the vehicle speed SPD is changed as shown in FIG. 19A, and in this case, the coolant temperature THW and the activity degree of the downstream-side $O_2$ sensor 15 are low as shown in FIGS. 19B and 19C. In this state, rich spikes as indicated by $X_1$ due to unburned gas may be generated in the output $V_2$ of the downstream-side $O_2$ sensor 15 as shown in FIG. 19E. Note that lean spikes may be generated in the case of a flow-in type signal processing circuit 113. Therefore, in the prior art, if the activation/deactivation of the downstream-side $O_2$ sensor 15 is determined by the output $V_2$ thereof, even in a "cold start", the closed-loop operation by the downstream-side $O_2$ sensor 15 is initiated at time $t_2'$, so that the air-fuel ratio control parameter such as FAF2 (or TDR1 and TDL1) is overcorrected to the rich side (or to the lean side in the case of a flow-in type signal processing circuit 113) as indicated by the dotted line in FIG. 19E. As a result, the exhaust emissions HC and CO (or $NO_x$ in the case of a flow-in type signal processing circuit 113) are remarkably increased. Contrary to this, in the present invention, since the closed-loop operation by the downstream-side $O_2$ sensor 15 is initiated at time $t_2$, the overcorrection of the air-fuel ratio feedback parameter FAF2 (or TDR1 and TDL1) is not carried out as indicated by the solid line in FIG. 19E, and accordingly, the exhaust emissions are reduced. Also, at time $t_3$ when the engine is started at a high temperature ("hot start"), the ouptput $V_2$ of the downstream-side $O_2$ sensor 15 is stable as shown in FIG. 19D, since there is little unburned gas. In this case, the activation/deactivation of the downstream-side $O_2$ sensor 15 is determined by the output $V_2$ thereof, and accordingly, the closed-loop operation by the downstream-side $O_2$ sensor 15 is initiated at time $t_4$.

Figure 20:
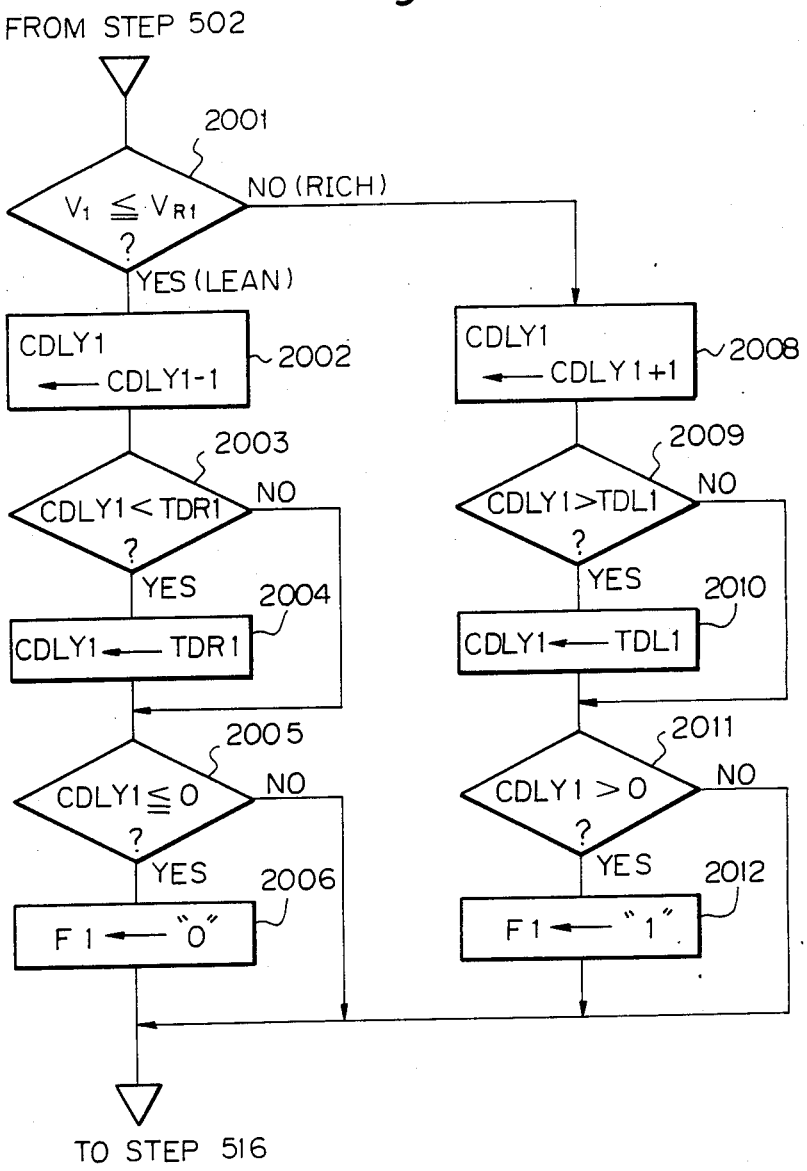

In FIG. 20, which is a modification of FIG. 5, a delay operation different from the of FIG. 5 is carried out. That is, at step 2001, if $V_1 \leqq V_{R1}$, which means that the current air-fuel ratio is lean, the control proceeds to step 2002 which decreases a first delay counter CDLY1 by 1. Then, at steps 2003 and 2004, the first delay counter CDLY1 is guarded by a minimum value TDR1. Note that TDR1 is a rich delay time period for which a lean state is maintained even after the output of the upstream-side $O_2$ sensor 13 is changed from the lean side to the rich side, and is defined by a negative value.

Note that, in this case, if CDLY1>0, this means that the delayed air-fuel ratio is rich, while, if CDLY≦0, this means that the delayed air-fuel ratio is lean.

Therefore, at step 2005, it is determined whether or not CDLY>0 is satisfied. As a result, if CDLY1<0, at step 2006, the first air-fuel ratio flag F1 is caused to be "0" (lean). Otherwise, the first air-fuel ratio flag F1 is unchanged, that is, the flag F1 remains at "1".

On the other hand, if $V_1 > V_{R1}$, which means that the current air-fuel ratio is rich, the control proceeds to step 2004 which increases the first delay counter CDLY1 by 1. Then, at steps 2009 and 2010, the first delay counter CDLY1 is guarded by maximum value TDL1. Note that TDL1 is a lean delay time period for which a rich state is maintained even after the output of the upstream-side $O_2$ sensor 13 is changed from the rich side to the lean side, and is defined by a positive value.

Then, at step 2011, it is determined whether or not CDLY>0 is satisfied. As a result, if CDLY>0, at step 2012, the first air-fuel ratio flag F1 is caused to be "1" (rich). Otherwise, the first air-fuel ratio flag F1 is unchanged, that is, the flag F1 remains at "0".

Figures 21A, 21B, 21C, 21D:
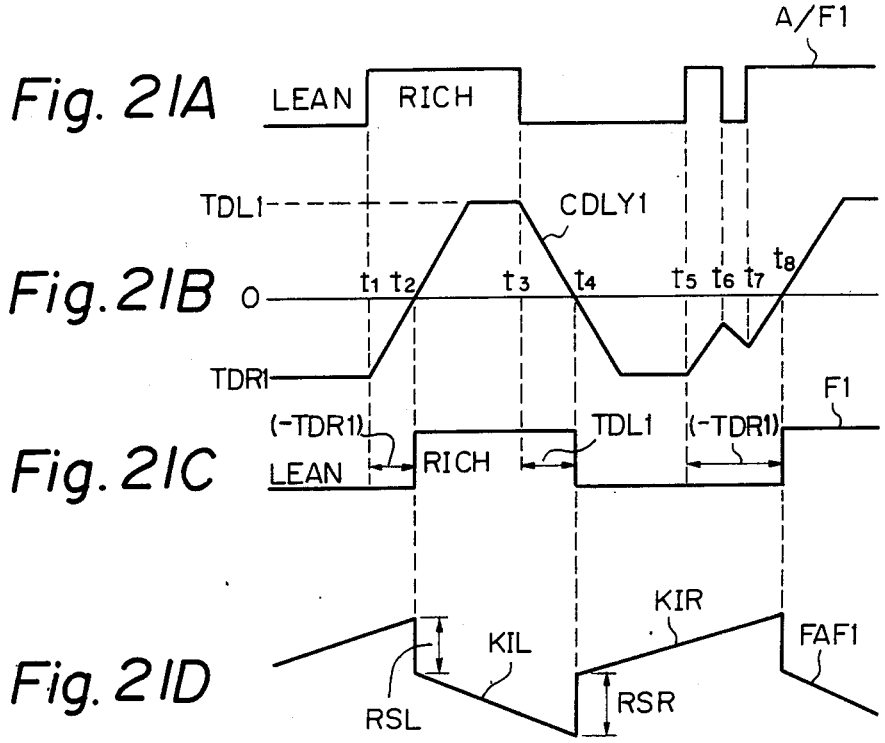
FIGS. 21A through 21D are timing diagrams for explaining the flow chart of FIG. 20.
Figure 22:
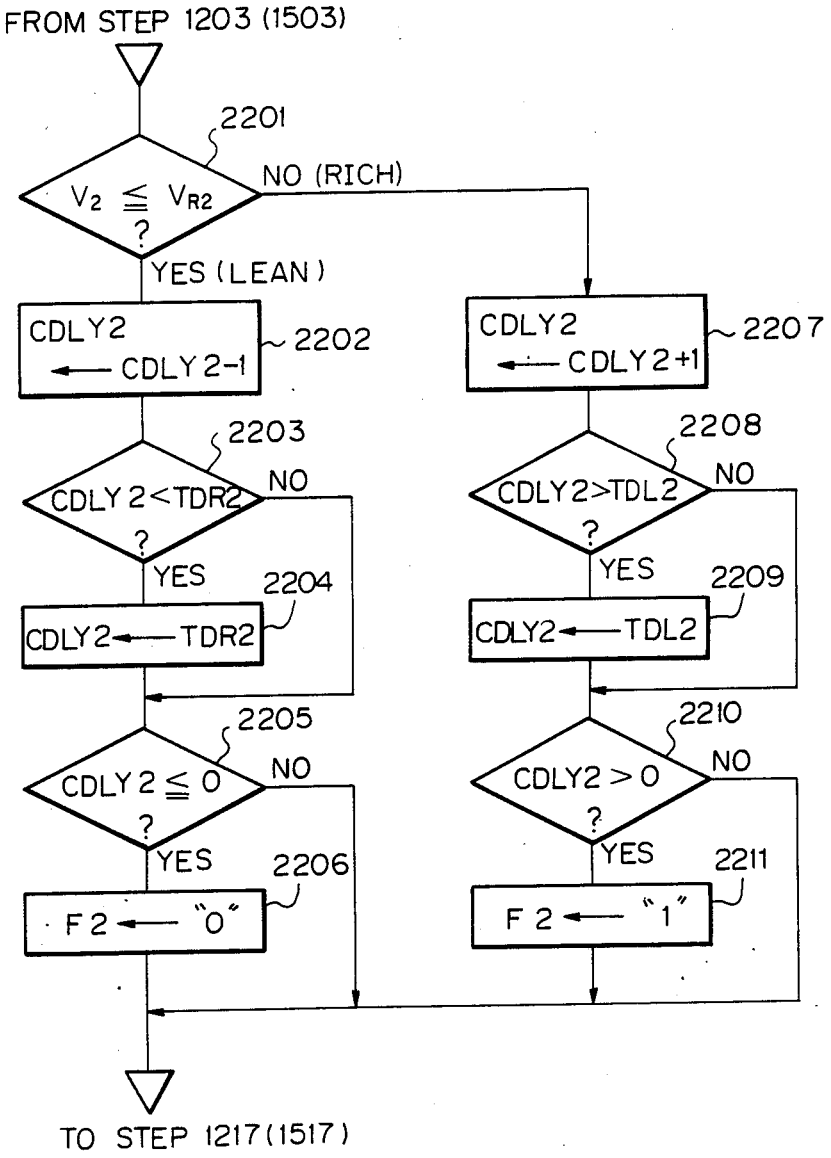

The operation by the flow chart of FIG. 20 will be further explained with reference to FIGS. 21A through 21D. As illustrated in FIG. 21A, when the air-fuel ratio A/F1 is obtained by the output of the upstream-side $O_2$ sensor 13, the first delay counter CDLY1 is counted up during a rich state, and is counted down during a lean state, as illustrated in FIG. 21B. As a result, the delayed air-fuel ratio A/F1' is obtained as illustrated in FIG. 21C. For example, at time $t_1$, even when the air-fuel ratio A/F1 is changed from the lean side to the rich side, the delayed air-fuel ratio A/F1 is changed at time $t_2$ after the rich delay time period TDR1. Similarly, at time $t_3$, even when the air-fuel ratio A/Fl is changed from the rich side to the lean side, the delayed air-fuel ratio A/F1' is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio A/F1' is reversed at time $t_8$. That is, the delayed air-fuel ratio A/F1' is stable when compared with the air-fuel ratio A/F1. Further, as illustrated in FIG. 21D, at every change of the delayed air-fuel ratio A/F1' from the rich side to the lean side, or vice versa, the correction amount FAF1 is skipped by the skip amount RSR or RSL, and also, the correction amount FAF1 is gradually increased or decreased in accordance with the delayed air-fuel ratio A/F1'.

Note that, in this case, during an open-control mode, the rich delay time period TDR1 is, for example, −12 (48 ms), and the lean delay time period TDL1 is, for example, 6 (24 ms).

In FIG. 23, which is a modification of FIG. 12, the same delay operation as in FIG. 20 is carried out, and its detailed explanation is omitted. In this case, however, the delay time periods TDR1 and TDL1 are both decreased at step 1519 and 1522, and the delay time periods TDR1 and TDL1 are both increased at steps 1525 and 1528.

Note that the calculated parameters FAF1 and FAF2, or FAF1, TDR1, and TDL1 can be stored in the backup RAM 106, thereby improving drivability at the re-starting of the engine.

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. This is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the skip amounts RSR and RSL, the integration amounts KIR and KIL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 1301 of FIG. 13 or at step 1601 of FIG. 16 is determined by the carburetor itself, i.e., the intake air negative pressure and the engine speed, and the air amount corresponding to TAU at step 1303 of FIG. 13 or at step 1603 of FIG. 16.

Further, a CO sensor, a lean-mixture sensor or the like can be also used instead of the $O_2$ sensor.

As explained above, according to the present invention, the activation/deactivation of the downstream-side air-fuel ratio sensor ($O_2$ sensor) can be properly determined, thereby improving the fuel consumption, the drivability, and the emissions.

We claim:

1. A method for controlling the air-fuel ratio in an internal combustion engine having a catalyst converter for removing pollutants in the exhaust gas thereof, and upstream-side and downstream, respectively, of said catalyst converter for detecting the concentration of a specific component in the exhaust gas, comprising the steps of:

adjusting an actual air-fuel ratio in accordance with the outputs of said upstream-side and downstream-side air-fuel ratio sensors;

detecting a coolant temperature of said engine prohibing the adjustment of said actual air-fuel ratio by the output of said downstream-side air-fuel ratio sensor in accordance with the detected coolant temperature, wherein said adjustment prohibiting step comprises the steps of:

determining whether or not said engine is started;

calculating a reference duration in accordance with the coolant temperature detected immediately after said engine is started or after a predetermined time period has passed after said engine is started;

calculating a duration after said engine is started; and determining whether or not said duration is smaller than said reference duration, thereby prohibiting the adjustment of said actual air-fuel ratio sensor when said duration is smaller than said reference duration;

detecting a deterioration degree of said downstream-side air-fuel ratio sensor; and correcting said reference duration in accordance with said deterioration degree.

2. A method as set forth in claim 1, wherein said deterioration degree detecting step comprises the steps of:

calculating an amplitude of the output of said downstream-side air-fuel ratio sensor;

calculating a repetition period of the output of said downstream-side air-fuel ratio sensor; and calculating said deterioration degree of said downstream-side air-fuel ratio sensor in accordance with said amplitude and repetition period of the output of said downstream-side air-fuel ratio sensor.

3. A method as set forth in claim 2, wherein said detetioration degree detecting step further comprises the steps of:

calculating a blunt value of said amplitude of the output of said downstream-side air-fuel ratio sensor; and calculating a blunt value of said repetition period of said downstream-side air-fuel ratio sensor, thereby calculating said deterioration degree of said downstream-side air fuel-ratio sensor in accordance with said blunt amplitude and blunt repetition period of the output of said downstream-side air-fuel ratio sensor.

4. An apparatus for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising:

means for adjusting an actual air-fuel ratio in accordance with the outputs of said upstream-side and downstream-side air-fuel ratio sensors;

means for detecting a coolant temperature of said engine;

means for prohibiting the adjustment of said actual air-fuel ratio by the output of said downstream-side air-fuel ratio sensor in accordance with the detected coolant temperature, wherein said adjustment probihiting means comprises:

means for determining whether or not said engine is started;

means for calculating a reference duration in accordance with the coolant temperature detected immediately after said engine is started or after a predetermined time period has passed after said engine is started;

means for calculating a duration after said engine is started; and means for determining whether or not said duration is smaller than said reference duration, thereby prohibiting the adjustment of said actual air-fuel ratio by the output of said downstream-side air fuel ratio sensor when said duration is smaller than said reference duration;

means for detecting a deterioration degree of said downstream-side air-fuel ratio sensor; and means for correcting said reference duration in accordance with said deterioration degree.

5. An apparatus as set forth in claim 4, wherein said deterioration degree detecting means comprises:

means for calculating an amplitude of the output of said downstream-side air-fuel ratio sensor;

means for calculating a repetition period of the output of said downstream-side air-fuel ratio sensor; and means for calculating said deterioration degree of said downstream-side air-fuel ratio sensor in accordance with said amplitude and repetition period of the output of said downstream-side air-fuel ratio sensor.

6. An apparatus as set forth in claim 5, wherein said deterioration degree detecting means further comprises:

means for calculating a blunt value of said amplitude of the output of said downstream-side air-fuel raio sensor; and means for calculating a blunt value of said repetition period of said downstream-side air-fuel ratio sensor, thereby calculating said deterioration degree of said downstream-side air-fuel ratio sensor in accordance with said blunt amplitude and blunt repetition period of the output of said downstream-side air-fuel ratio sensor.

7. A method for controlling the air-fuel ratio in an internal combustion engine having a catalyst converter for removing pollutants in the exhaust gas thereof, and upstream-side and downstream-side air-fuel ratio sensors, disposed upstream and downstream, respectively, of said catalyst converter, for detecting the concentration of a specific component in the exhaust gas, comprising the steps of:

determining whether or not said upstream-side air-fuel ratio sensor is in an activation state;

detecting a coolant temperature of said engine;

determining whether or not said downstream-side air-fuel ratio sensor is in an activation state in accordance with the detected coolant temperature;

carrying out an air-fuel ratio feedback control operation in accordance with only the output of said upstream side air-fuel ratio sensor when said upstream-side air-fuel ratio sensor is in the activation state and said downstream-side air-fuel ratio sensor is not in the activation state; and carrying out an air-fuel ratio feedback control operation in accordance with the outputs of said upstream-side and downstream-side air-fuel ratio sensors when said upstream-side and downstream-side air-fuel ratio sensors are both in the activation state.

8. A method for controlling the air-fuel ratio in an internal combustion engine having a catalyst converter for removing pollutants in the exhaust gas thereof, and upstream-side and downstream-side air-fuel ratio sensors, disposed upstream and downstream, respectively, of said catalyst converter, for detecting the concentration of a specific component in the exhaust gas, comprising the steps of:

determining whether or not said upstream-side air-fuel ratio sensor is in a activation state by determining whether or not the output of said upstream-side air-fuel ratio sensor is once changed between the rich side and the lean side;

detecting a coolant temperature of said engine;

determining whether or not said downstream-side air-fuel ratio sensor is in an activation state in accordance with the detected coolant temperature;

carrying out an air-fuel ratio feedback control operation in accordance with only the output of said upstream-side air-fuel ratio sensor when said upstream-side air-fuel ratio sensor is in the activation state and said downstream-side air-fuel ratio sensor is not in the activation state; and carrying out an air-fuel ratio feedback control operation in accordance with the outputs of said upstream-side and downstream-side air-fuel ratio sensors when said upstream-side and downstream-side air-fuel ratio sensors are both in the activation state.

9. A method for controlling the air-fuel ratio in an internal combustion engine having a catalyst converter for removing pollutants in the exhaust gas thereof, and upstream-side and downstream-side air-fuel ratio sensor, disposed upstream and downstream, respectively, of said catalyst converter, for detecting the concentration of a specific component in the exhaust gas, comprising the steps of:

detecting a coolant temperature of said engine;

determining whether or not the detected coolant temperature is higher than a first predetermined value;

determining whether or not the detected temperature is higher than a second predetermined value;

carrying out an air-fuel ratio feedback control operation in accordance with the output of said upstream-side air-fuel ratio sensor according to when the coolant temperature is higher than said first predetermined value and the output of said upstream-side air-fuel ratio sensor is once changed between the rich side and the lean side; and carrying out an air-fuel ratio feedback control operation in accordance with the output of said downstream-side air-fuel ratio sensor according to when the coolant temperature is higher than said second predetermined value.

10. A method for controlling the air-fuel ratio in an internal combustion engine having a catalyst converter for removing pollutants in the exhaust gas thereof, and upstream-side and downstream-side air-fuel ratio sensors, disposed upstream and downstream, respectively, of said catalyst converter, for detecting the concentration of a specific component in the exhaust gas, comprising the steps of;

determining whether or not said upstream-side air-fuel ratio sensor is in an activation state;

determining whether or not said engine is being started;

detecting a coolant temperature of said engine when said engine is being started or immediately thereafter;

calculating a reference duration in accordance with the detected coolant temperature, said reference duration being needed for said downstream-side air-fuel ratio sensor to be activated;

calculating a reference duration in accordance with the detected coolant temperature, said reference duration being needed for said downstream-side air-fuel ratio sensor to be activated;

calculating a duration after said engine is started;

determining whether or not said duration is smaller than said reference duration;

carrying out an air-fuel ratio feedback control operation in accordance with only the output of said upstream-side air-fuel ratio sensor when said upstream-side air-fuel ratio sensor is in the activation state and said duration is smaller than said reference duration; and carrying out an air-fuel feedback control operation in accordance with the outputs of said upstream-side and downstream-side air-fuel ratio sensors when said upstream-side air-fuel ratio sensor is in the activation state and said duration is not smaller than said reference duration.

11. A method as set forth in claim 10, wherein said activation state determining step comprises a step of determining whether or not the output of said upstream-side air-fuel ratio sensor is once changed between the rich side and the lean side.

12. A method as set forth in claim 10, wherein said duration calculating step comprises the steps of:

calculating a rate in accordance with at least an engine load; and increasing or decreasing said duration at said rate.

13. A method as set forth in claim 12, wherein said rate is increased when said engine load is increased, so that said duration is more rapidly increased when said engine load is larger.

14. A method as set forth in claim 10, wherein said duration calculating step comprises the steps of:

calculating a rate in accordance with at least an engine speed; and increasing or decreasing said duration at said rate.

15. A method as set forth in claim 14, wherein said rate is increased when said engine speed is increased, so that said duration is more rapidly increased when said engine speed is larger.

16. A method as set forth in claim 10, wherein said duration calculating step comprises the steps of:

calculating a rate in accordance with an engine load and an engine speed; and increasing or decreasing said duration at said rate.

17. A method for controlling the air-fuel ratio in an internal combustion engine having a catalyst converter for removing pollutants in the exhaust gas thereof, and upstream-side and downstream-side air-fuel ratio sensors, disposed upstream and downstream, respectively of said catalyst converter, for detecting the concentration of a specific component in the exhaust gas, comprising the steps of:

determining whether or not said upstream-side air-fuel ratio sensor is in an activation state;

detecting a coolant temperature of said engine;

determining whether said engine is started at a low temperature state of said engine or at a high temperature state of said engine;

determining whether or not said downstream-side air-fuel ratio sensor is in an activation state by whether or not the output of said downstream-side air-fuel ratio sensor is once changed between the rich side and the lean side, when said engine is started at the high temperature state;

determining whether or not said downstream-side air-fuel rataio sensor is in the activation state by whether or not the coolant temperature is higher than a predetermined value, when said engine is started at the low temperature state;

carrying out an air-fuel ratio feedback control operation in accordance with only the output of said upstream-side air-fuel ratio sensor when said upstream-side air-fuel ratio sensor is in the activation state and said downstream-side air-fuel ratio sensor is not in the activation state; and carrying out an air-fuel ratio feedback control operation in accordance with the outputs of said upstream-side and downstream-side air-fuel ratio sensors when said upstream-side and downstream-side air-fuel ratio senosrs are both in the activation state.

18. A method as set forth in claim 17, wherein said upstream-side air-fuel ratio sensor activation determining step comprises a step of determining whether or not the output of said upstream-side air-fuel ratio sensor is once changed between the rich side and the lean side.

19. An apparatus for controlling the air-fuel ratio in an internal combustion engine having a catalyst converter for removing pollutants in the exhaust gas thereof, and upstream-side and downstream-side air-fuel ratio sensors, disposed upstream and downstream, respectively, of said catalyst converter, for detecting the concentration of a specific component in the exhaust gas, said apparatus comprising:

means for determining whether or not said upstream-side air-fuel ratio sensor is in an activation state;

means for detecting a coolant temperature of said engine;

means for determining whether or not said downstream-side air-fuel ratio sensor is in an activation state in accordance with the detected coolant temperature;

means for carrying out an air-fuel ratio feedback control operation in accordance with only the output of said upstream-side air-fuel ratio sensor when said upstream-side air-fuel fuel ratio sensor is in the activation state and said downstream-side air-fuel ratio sensor is not in the activation state; and means for carrying out an air-fuel ratio feedback control operation in accordance with the outputs of said upstream-side and downstream-side air-fuel ratio sensors when said upstream-side and downstream-side air-fuel ratio sensors are both in the activation state.

20. An apparatus for controlling the air-fuel ratio in an internal combustion engine having a catalyst converter for removing pollutants in the exhaust gas thereof, and upstream-side and downstream-side air-fuel ratio sensors, disposed upstream and downstream, respectively, of said catalyst converter, for detecting the concentration of a specific component in the exhaust gas, said apparatus comprising:

means for determining whether said upstream-side air-fuel ratio sensor is in a activation state by determining whether the output of said upstream-side air-fuel ratio sensor is once changed between the rich and the lean side;

means for detecting a coolant temperature of said engine;

means for determining whether said downstream-side air-fuel ratio sensor is in an activation state in accordance with the detected coolant temperature;

means for carrying out an air-fuel ratio feedback control opertion in accordance with only the output of said upstream-side air-fuel ratio sensor when said upstream-side air-fuel ratio sensor is in the activation state and said downstream-side air-fuel ratio sensor is not in the activation state; and means for carrying out an air-fuel ratio feedback control operation in accordance with the outputs of said upstream-side and downstream-side air-fuel ratio sensors when said upstream-side and downstream-side air-fuel ratio sensors are both in the activation state.

21. An apparatus for controlling the air-fuel ratio in an internal combustion engine having a catalyst converter for removing pollutants in the exhaust gas thereof, and upstream-side and downstream-side air-fuel ratio sensors, disposed upstream and downstream, respectively, of said catalyst converter, for detecting the concentration of a specific component in the exhaust gas, said apparatus comprising:

means for detecting a coolant temperature of said engine;

means for determining whether the detected coolant temperature is higher than a first predetermined value;

means for determining whether the detected temperature is higher than a second predetermined value;

means for carrying out an air-fuel ratio feedback control operation in accordance with the output of said upstream-side air-fuel ratio sensor according to when the coolant temperature is higher than said first predetermined value and the output of said upstream-side air-fuel ratio sensor is once changed between the rich side and the lean side; and means for carrying out an air-fuel ratio feedback control operation in accordance with the output of said downstream-side air-fuel ratio sensor according to when the coolant temperature is higher than said second predetermined value.

22. An apparatus for controlling the air-fuel ratio in an internal combustion engine having a catalayst converter for removing pollutants in the exhaust gas thereof, and upstream-side and downstream-side air-fuel ratio sensors, disposed upstream and downstream, respectively, of said catalyst converter, for detecting the concentration of a specific component in the exhaust gas, said apparatus comprising:

means for determining whether said upstream-side air-fuel ratio sensor is in an activation state;

means for determining whether or not said engine is being started;

means for detecting a coolant temperature of said engine when said engine is being started or immediately thereafter;

means for calculating a reference duration in accordance with the detected coolant temperature, said reference duration being needed for said downstream-side air-fuel ratio sensor to be activated;

means for calculating a reference duration in accordance with the detected coolant temperature, said reference duration being needed for said downstream-side air-fuel ratio sensor to be activated;

means for calculating a duration after said engine is started;

means for determining whether said duration is smaller than said reference duration;

means for carrying out an air-fuel ratio feedback control operation in accordance with only the output of said upstream-side air-fuel ratio sensor when said upstream-side air-fuel ratio sensor is in the activation state and said duration is smaller than said reference duration; and means for carrying out an air-fuel ratio feedback control operation in accordance with the outputs of said upstream-side and downstream-side air-fuel ratio sensors when said upstream-side air-fuel ratio sensor is in the activation state and said duration is not smaller than said reference duration.

23. An apparatus as set forth in claim 22, wherein said means for determining said activation state comprises means for determining whether the output of said upstream-side air-fuel ratio sensor is once changed between the rich side and the lean side.

24. An apparatus as set forth in claim 22, wherein said means for calculating said duration comprises:

means for calculating a rate in accordance with at least an engine load; and means for increasing or decreasing said duration at said rate.

25. An apparatus as set forth in claim 24, wherein said rate is increased when said engine load is increased, so that said duration is more rapidly increased when said engine load is larger.

26. An apparatus as set forth in claim 22, wherein said means for calculating said duration comprises:

means for calculating a rate in accordance with at least an engine speed; and means for increasing or decreasing said duration at said rate.

27. An apparatus as set forth in claim 26, wherein said rate is increased when said engine speed is increased, so that said duration is more rapidly increased when said engine speed is larger.

28. An apparatus as set forth in claim 22, wherein said means duration calculating step comprises the steps of:

means for calculating a rate in accordance with an engine load and an engine speed; and means for increasing or decreasing said duration at said rate.

29. An apparatus for controlling the air-fuel ratio in an internal combustion engine having a catalyst converter for removing polutants in the exhaust gas thereof, and upstream-side and downstream-side air-fuel ratio sensors, disposed upstream and downstream, respectively, of said catalyst converter, for detecting the concentration of a specific component in the exhaust gas, said apparatus comprising:

means for determining whether said upstream-side air-fuel ratio sensor is in an activation state;

means for detecting a coolant temperature of said engine;

means for determining whether said engine is started at a lower temperature state of said engine or at a high temperature state of said engine;

means for determining whether said downstream-side air-fuel ratio sensor is in an activation state by whether the output of said downstream-side air-fuel ratio sensor is once changed between the rich side and the lean side, when said engine is started at the high temperature state;

means for determining whether said downstream-side air-fuel ratio sensor is in the activation state by whether the coolant temperature is higher than a predetermined value, when said engine is started at the low temperature state;

means for carrying out an air-fuel ratio feedback control operation in accordance with only the output of said upstream-side air-fuel ratio sensor when said upstream-side air-fuel ratio sensor is in the activation state and said downstream-side air-fuel ratio sensor is not in the activation state; and means for carrying out an air-fuel ratio feedback control operation in accordance with the outputs of said upstream-side and downstream-side air-fuel ratio sensors when said upstream-side and downstream-side air-fuel ratio sensors are both in the activation state.

30. An apparatus as set forth in claim 29, wherein said means for determining upstream-side air-fuel ratio sensor activation comprises means for determining whether the output of said upstream-side air-fuel ratio sensor is once changed between the rich side and the lean side.

31. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas, comprising the steps of:

adjusting an actual air-fuel ratio in accordance with the outputs of said upstream-side and downstream-side air-fuel ratio sensors;

detecting a coolant temperature of said engine; and prohibiting the adjustment of said actual air-fuel ratio by the output of said downstream-side air-fuel ratio sensor in accordance with the detected coolant temperature;

wherein said air-fuel ratio adjusting step comprises the steps of:

calculating an air-fuel ratio feedback control parameter in accordance with the output of the said downstream-side air-fuel ratio sensor;

calculating an air-fuel ratio correction amount in accordance with the output of said downstream-side air-fuel ratio sensor and said air-fuel ratio feedback control parameter; and adjusting the actual air-fuel ratio in accordance with said air-fuel ratio correction amount; and wherein said air-fuel ratio feedback control parameter is determined by a lean skip amount by which said air-fuel ratio correction amount is skipped down when the output of said downstream-side air-fuel ratio sensor is switched from the lean side to the rich side and a rich skip amount of by which said air-fuel ratio correction amount is skipped up when the output of said downstream-side air-fuel ratio sensor is switched from the rich side to the lean side.

32. A method as set forth in claim 31, wherein said air-fuel ratio feedback control parameter calculating step comprises the steps of:

increasing said lean skip amount when the output of said downstream-side air-fuel ratio sensor is on the rich side; and decreasing said lean skip amount when the output of said downstream-side air-fuel ratio sensor is on the lean side.

33. A method as set forth in claim 31, wherein said air-fuel ratio feedback control parameter calculating step comprises the steps of:

increasing said rich skip amount when the output of said downstream-side air-fuel ratio sensor is on the rich side; and decreasing said rich skip amount when the output of said downstream-side air-fuel ratio sensor is on the lean side.

34. A method as set forth in claim 31, wherein said air-fuel ratio feedback control parameter calculating step comprises the steps of:

increasing said lean skip amount and decreasing said rich skip amount when the output of said downstream-side air-fuel ratio sensor is on the rich side; and decreasing said lean skip amount and increasing said rich skip amount when the output of said downstream-side air-fuel ratio sensor is on the lean side.

35. An apparatus for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting the concentration of a specific component in the exhaust gas comprising:

means for adjusting an actual air-fuel ratio in accordance with the outputs of said upstream-side and downstream-side air-fuel ratio sensors;

means for detecting a coolant temperature of said engine; and means for prohibiting the adjustment of said actual air-fuel ratio by the output of said downstream-side air-fuel ratio sensor in accordance with the detected coolant temperature;

wherein said means for adjusting said air-fuel ratio comprises:

means for calculating an air-fuel ratio feedback control parameter in accordance with the output of said downstream-side air-fuel ratio sensor;

means for calculating an air-fuel ratio correction amount in accordance with the output of said upstream-side air-fuel ratio sensor and said air-fuel ratio feedback control parameter; and means for adjusting the actual air-fuel ratio in accordance with said air-fuel ratio correction amount;

wherein said air-fuel ratio feedback control parameter is determined by a lean skip amount by which said air-fuel ratio correction amount is skipped down when the output of said downstream-side air-fuel ratio sensor is switched from the lean side to the rich side and a rich skip amount by which said air-fuel ratio correction amount is skipped up when the output of said downstream-side air-fuel sensor is switched from the rich side to the lean side.

36. An apparatus as set forth in claim 35, wherein said air-fuel ratio feedback control parameter calculating means comprises:

means for increasing said lean skip amount when the output of said downstream-side air-fuel ratio sensor is on the rich side; and means for decreasing said lean skip amount when the output of said downstream-side air-fuel ratio sensor is on the lean side.

37. An apparatus as set forth in claim 35, wherein said air-fuel ratio feedback control parameter calculating means comprises:

means for increasing said rich skip amount when the output of said downstream-side air-fuel ratio sensor is on the rich side; and means for decreasing said rich skip amount when the output of said downstream-side air-fuel ratio sensor is on the lean side.

38. An apparatus as set forth in claim 35, wherein said air-fuel ratio feedback control parameter calculating means comprises:

means for increasing said lean skip amount and decreasing said rich skip amount when the output of said downstream-side air-fuel ratio sensor is on the rich side; and means for decreasing said lean skip amount and increasing said rich skip amount when the output of said downstream-side air-fuel ratio sensor is on the lean side.

* * * * *